United States Patent [19]

Fehling et al.

[11] 4,365,731

[45] Dec. 28, 1982

[54] REFRACTORY STRUCTURES

[75] Inventors: Hans R. Fehling, Zug, Switzerland; Horst Hase, Wiesbaden, Fed. Rep. of Germany

[73] Assignee: Didier-Werke, A.G., Wiesbaden, Fed. Rep. of Germany

[21] Appl. No.: 181,476

[22] Filed: Aug. 26, 1980

Related U.S. Application Data

[63] Continuation of Ser. No. 763,160, Jan. 27, 1977, abandoned.

[51] Int. Cl.[3] ..... B22D 37/00

[52] U.S. Cl. ..... 222/600; 222/592; 222/603

[58] Field of Search ..... 222/559, 561, 600, 603, 222/592; 106/58

[56] References Cited

U.S. PATENT DOCUMENTS

| | | | |
|---|---|---|---|
| 1,995,941 | 3/1935 | Pugh . | |
| 3,773,226 | 11/1973 | Kutzer | 222/148 |
| 3,825,241 | 7/1974 | Shapland | 266/38 |
| 3,838,798 | 10/1974 | Voss | 222/148 |
| 3,866,806 | 2/1975 | Shapland, Jr. | 222/504 |

FOREIGN PATENT DOCUMENTS

| | | |
|---|---|---|
| 1407502 | 9/1975 | United Kingdom . |
| 441577 | 1/1968 | Australia . |
| 444343 | 9/1971 | Australia . |
| 458437 | 7/1972 | Australia . |
| 474387 | 8/1975 | Australia . |
| 324593 | 11/1974 | Austria . |
| 961638 | 1/1975 | Canada . |
| 968524 | 6/1975 | Canada . |
| 976350 | 10/1975 | Canada . |
| 979647 | 12/1975 | Canada . |
| 1268793 | 5/1968 | Fed. Rep. of Germany . |
| 1935401 | 12/1970 | Fed. Rep. of Germany . |
| 2019550 | 11/1971 | Fed. Rep. of Germany . |
| 2218155 | 4/1972 | Fed. Rep. of Germany . |
| 2102059 | 8/1972 | Fed. Rep. of Germany . |
| 2417490 | 11/1974 | Fed. Rep. of Germany . |
| 2453245 | 5/1975 | Fed. Rep. of Germany . |
| 2264969 | 8/1975 | Fed. Rep. of Germany . |
| 2076057 | 10/1971 | France . |
| 2172057 | 9/1973 | France . |
| 2248898 | 6/1976 | France . |
| 89017 | 4/1977 | Poland . |
| 91776 | 10/1977 | Poland . |
| 91849 | 12/1977 | Poland . |
| 102354 | 8/1979 | Poland . |
| 707732 | 4/1954 | United Kingdom . |
| 849730 | 9/1960 | United Kingdom . |
| 873283 | 7/1961 | United Kingdom . |
| 1148340 | 4/1969 | United Kingdom . |
| 1196993 | 7/1970 | United Kingdom . |
| 1254408 | 11/1971 | United Kingdom . |
| 1342670 | 1/1974 | United Kingdom . |
| 1354412 | 6/1975 | United Kingdom . |

OTHER PUBLICATIONS

"Metals Abstracts" vol. 8, Aug. 1975, 51-0524.

*Primary Examiner*—Charles A. Marmor
*Attorney, Agent, or Firm*—Stevens, Davis, Miller & Mosher

[57] ABSTRACT

A refractory structure comprising a body of refractory concrete material defining at least one discharge passage for molten metal passing through the body and at least one reinforcing element located within the body or forming a face to face thereof and interlocked mechanically with the refractory concrete with which it is in intimate contact over the whole of any of the surface of the reinforcing element which is juxtaposed to the refractory concrete, the reinforcing element being separated by refractory concrete material from any surface of the refractory structure which contacts the molten metal in use.

28 Claims, 39 Drawing Figures

REFRACTORY STRUCTURES

Figure 1:
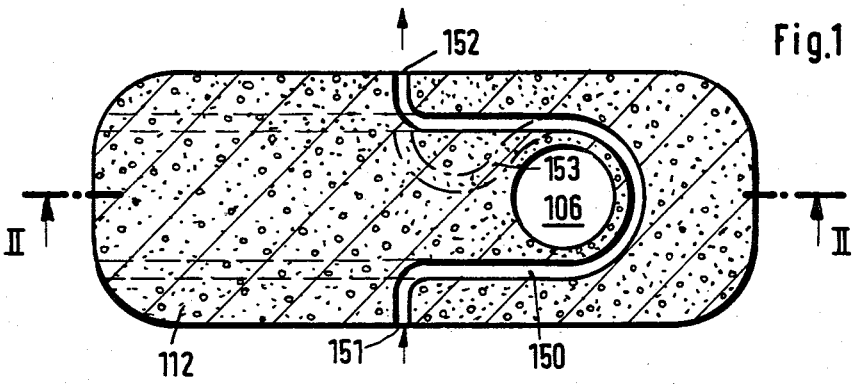

This is a continuation of application Ser. No. 763,160 filed Jan. 27, 1977, now abandoned.

The invention relates to refractory bodies and finds particular use as wearing parts for use in the outlets of metallurgical vessels such as casting ladles and tundishes and as refractory structures for use in outlet control devices for such vessels and in particular sliding gate nozzle apparatus.

The invention is described with particular reference to the casting of steel but the refractory wearing parts according to the invention are also applicable to the casting of other metals which cause considerable wear because of their high melting point or their corrosive nature.

Such apparatus comprises a stationary refractory upper plate defining a discharge passage and adapted to be located on the outside of the vessel in juxtaposition to the outlet orifice of the vessel, e.g. by being held in a metal frame attached to the shell of the vessel, and a movable refractory sliding plate defining a discharge passage and mounted for movement between an open position in which the discharge passages of the two plates are in register and a closed position in which the movable plate shuts off the discharge passage of the fixed plate.

Movement of the movable plate can be rotatory though a straight sliding motion is preferred.

One form of such apparatus has a fixed upper plate and a movable lower plate. Such apparatus will be referred to herein as a two plate sliding gate nozzle apparatus. The movable plate is preferably mounted for movement in a metal casing, and may incorporate an outlet nozzle or cooperate with one which is also movably mounted in the metal casing.

Another form of such apparatus has the movable plate mounted for movement between upper and lower fixed plates and is thus substantially parallel faced and the lower fixed plate incorporates or cooperates with an outlet nozzle. Such apparatus will be referred to as a three plate sliding gate nozzle apparatus.

Conventional refractory plates and nozzles for use in such apparatus are made by pressing a refractory granular mass and then firing it at high temperature and then drilling out the outlet passage.

Refractory wearing parts of the described kind are exposed in use to widely varying thermal stresses. On the one hand such refractory wearing parts are exposed during the pour to very high temperatures at which metals have a major corrosive and erosive action on refractory materials. On the other hand such refractory wearing parts are exposed at the start of the pour to an unusually severe and sudden thermal shock which gives rise to correspondingly high mechanical stresses due to differential thermal expansion. For both these reasons the service life of known refractory wearing parts of the kind contemplated is short. For example, on average a sliding plate requires replacement after only two pours, representing, for example, a total casting time of only two hours.

According to the present invention a refractory structure which may be used as a fixed or sliding plate for a sliding gate nozzle or as a sleeve or nozzle brick for the outlet from a metallurgical vessel comprises (A) a body of cast refractory concrete material defining at least one discharge passage passing through the body and (B) at least one reinforcing element, preferably metallic, located within the body or forming a face or faces thereof and interlocked mechanically with the refractory concrete with which it is in intimate contact over the whole of any of its surface which is juxtaposed to the refractory concrete or (C) means defining at least one duct for a working fluid in the body or (D) the discharge passage being defined by an insert of material embedded in the refractory concrete and having better wear resistance then the refractory concrete, or (A), (B) and (C), or (A), (B) or (C) and (D) or (A), (B), (C) and (D).

The metallic reinforcing element is referred to as being interlocked mechanically with the refractory concrete. It is to be understood that this means not only arrangements in which the interlock is such that the cast refractory concrete body and the reinforcing element cannot be separated without breaking one or other of these components, but also arrangements in which the interlock is at least operative in the situation in which the plate is actually used so as to resist separation of the components at least so far as shear forces in the principal plane of the plate are concerned.

Thus when the structure is in the form of a plate in a sliding gate nozzle it is held in compression in use, both at its edges and at its opposed principal faces. It is thus only essential that the mechanical interlock is sufficient to resist separation of the cast concrete body from the reinforcing element in a direction parallel to the principal plane of the plate. However arrangements in which the components are inseparably attached to each other are preferred.

An object of the first aspect of the present invention is to provide refractory wearing parts of the kind contemplated in such a way that their service life is extended. The invention achieves this object by making the refractory part of a refractory concrete and by forming at least one duct in the refractory concrete for the circulation therethrough of a working medium such as a heating or cooling fluid.

In a first aspect of the invention, a refractory wearing part is provided with one or more ducts or a system of ducts formed and distributed as described in the wearing part so as to permit the introduction of a heating or cooling fluid into the interior of the part where the occurrence of temperature shock or of undesirably high temperatures in the material of the refractory part may be avoided or reduced. By appropriately controlling the supply of heating and cooling fluid it is possible for example to raise the temperature of the refractory wearing part prior to the start of a pour sufficiently to obviate the material being damaged by the temperature shock at the start of the pour. During the pour the temperature peaks which otherwise arise in the wall of the passage may be reduced to an acceptable level by introducing a coolant for a suitable period of time. In this way, on the one hand, temperature changes can be made to proceed gradually and, on the other hand, the temperature peaks to which the refractory part is exposed can be limited to a level at which the service life of the part will be increased.

In a preferred form of the invention the refractory structure is in the form of a plate, the discharge passage being transverse to the major plane of the plate and the ducts being at least partially and preferably substantially parallel to the principal plane of the plate. Preferably the ratio of the maximum longitudinal dimension of the sliding surface of the plate to the minimum thickness of the plate is in the range of ratios of 25:1 to 7.5:1 and more preferably 20:1 to 10:1 and especially 15:1 to 10:1.

In a preferred form of the invention the ducts are tortuous. The term "tortuous duct" covers any duct which undergoes a change of direction in its passage from its commencement at an inlet aperture to the body to its emergence at an outlet aperture to the body. These ducts may have a circular or non-circular cross section, such as a rectangular, oval or other cross section. Parts of the ducts may be curved, others straight and they may intercommunicate at an angle, for instance at a right angle. The ducts may be formed by metal or ceramic or other heat resistant tubes incorporated in the refractory wearing parts. Preferably at least the entry to a duct is formed by a metal insert to facilitate connection of the ducts to a supply of working fluid.

In another embodiment of the invention the refractory wearing part is of two-part construction, preferably being divided in a parting plane parallel to its principal plane and one of the components of the plate contains the duct or ducts with one open side in such a way that when combined with the other plate component or cover the open side of the duct or ducts is closed.

The cover is preferably flush with the surface of the plate which may have parallel principal surfaces. Preferably the inner edge of the cover is spaced away from the edges of the discharge opening. It may consist of refractory material, e.g. a ceramic or of steel.

The openings of the duct or ducts may be in the cover. Alternatively the inlet and outlet openings may be formed in the sides or ends of the plate. It is desirable that at least the inlet opening of the ducts should be formed by a metal insert to facilitate connecting the duct to a gas or liquid supply.

Refractory wearing parts according to the invention may be produced by pouring a refractory concrete into an appropriate mould, means determining the duct or ducts of desired cross section being disposed in the desired position inside the mould before the concrete is poured.

The means used for forming the duct or ducts may, if this is desirable, be of a temporary nature, for instance they may consist of a combustible material such as paper or synthetic plastics material, so that they can be removed by heating before the refractory wearing part is used for the first time, or may be such that their removal during first use will not result in a restriction of the duct cross section. Alternatively the means may also consist of a removable solid material that possesses the desired shape of the duct and that is inserted in the mould (as a core) and removed after the refractory part has been moulded, for instance they may consist of a combustible material such as paper or synthetic plastics material, so that they can be removed by heating before the refractory wearing part is used for the first time, or may be such that their removal during first use will not result in a restriction of the duct cross section. Alternatively the means may also consist of a removable solid material that possesses the desired shape of the duct and that is inserted in the mould (as a core) and removed after the refractory part has been moulded, for instance by the application of heat, for instance by making such a core of a low melting alloy, such as a tin alloy or Rose's metal. This has the advantage of permitting ducts of non-circular cross section to be easily produced. Alternatively the duct or ducts may be formed of heat resistant metal or ceramic tubes or pipes.

Preferably the ducts are so shaped that they embrace the discharge passage traversing the sliding plate by surrounding the same in at least 180° arc and preferably in a 360° circle. In plates having asymmetrically disposed discharge passages the ducts will with advantage run at least from the middle, preferably from the remote end of the plate in an at least 180° arc around the discharge passage and then preferably extend back again at least to the middle and preferably to the same end of the plate.

The inlet openings into ducts surrounding the discharge passage are preferably tangentially disposed to the circle to facilitate circulation of the working fluid which may be heating or cooling fluid.

The heating fluid and the cooling fluid are preferably gaseous. With advantage a heating fluid may be a combustion gas, whereas the coolant may with advantage be compressed air.

The invention also extends to a method of conditioning, particularly sliding plates in sliding gate nozzles for vessels containing molten metal, which is characterised in that heating fluids and/or cooling fluids are circulated through at least one duct contained in the sliding plate.

The invention also relates to refractory structures containing a gas-permeable insert and adapted for use in or with a vessel which is itself adapted to contain molten metal, particularly for discharge control means on vessels adapted to contain a metal melt.

Refractory structures incorporating gas-permeable inserts have been described for example in German Pat. Specn. No. 1935401, German Pat. Specn. No. 2019550, and German as-filed Patent Specn. No. 2218155.

The purposes of the gas-permeable inserts include that of permitting major volumes of a gas to be introduced under pressure into the space or cross section provided for the discharge of the metal melt.

When such gas-permeable inserts are provided in conventional fired refractory plates or nozzles they must be inserted into pre-bored holes and not inconsiderable difficulties arise, particularly in quantity production, in firmly securing them in their holes and in making suitable arrangements for the supply of the gas.

It is an object of the invention to avoid these drawbacks and to provide more simply a refractory component of the kind contemplated above. In the present invention this object is achieved by embedding the gas-permeable insert in refractory concrete from which the refractory component is formed.

The gas-permeable porous insert is embedded preferably directly, in the body of refractory concrete, for instance by pouring and vibrating the concrete around the insert. Ducts for working fluid communicating with the gas permeable insert may be formed in the in the refractory concrete. However, if desired, the insert may be previously located in a metal surround in such a way that a cavity remains between an inner face of the insert and the refractory concrete body, the gas supply means, for instance a duct moulded into the concrete opening into this cavity. The ducts extends preferably to a remote end face of the component. In the case of a sleeve (nozzle brick) containing a central metal discharge passage or of the fixed plate of a 2-plate sliding gate nozzle, the gas-permeable insert may with advantage extend to the wall of the metal discharge passage traversing the part and may encompass the entire periphery of this passage, thus itself forming the wall of this passage.

With a sliding plate for a two-plate sliding gate nozzle (i.e. comprising one fixed and one movable plate), the gas-permeable insert is preferably located in the sliding plate and flush with the top face of the latter so as to be below the discharge passage of the fixed plate when the gate is shut. The insert may be adapted to be supplied with gas via a duct extending from one end or side wall of the plate or the bottom face of the plate.

When the inlet is in the bottom face of the sliding plate of a three-plate sliding gate (i.e. having two fixed plates and one movable plate in the middle), access thereto for the gas may be obtained via a duct in the lower fixed plate. This duct is preferably formed in a cast refractory concrete plate as described above.

The use of gas-permeable inserts which are embedded in a refractory component of a 2- or 3-plate sliding gate nozzle made of refractory concrete is of particular importance in preventing the gates from becoming inoperative by the molten metal freezing in the discharge passage above the closed sliding plate. The gas preferably used is an inert gas, such as argon or nitrogen.

The form of construction according to the invention in which a gas-permeable or porous insert is embedded in a refractory part made of refractory concrete, for instance by pouring and possibly compacting the concrete, e.g. by vibration, around the insert, provides an oustandingly reliable bond between the gas-permeable insert and the refractory concrete and surprisingly there is no significant impairment of the permeability to gas of the gas-permeable or porous insert.

The gas-permeable insert and the ducts for the working fluid may be located on a metal plate which is flush with the underface of the sliding or middle plate.

The working fluid may be conducted to the gas-permeable insert through an opening in the metal plate in the bottom of the sliding plate, which opening communicates with a recess in the upper surface of the bottom fixed plate, and the recess may be connected to an external gas supply pipe.

Alternatively the working fluid may be conducted to the gas-permeable insert through an opening in the upper surface of the sliding plate, which opening communicates with a recess in the undersurface of the upper fixed plate, and the recess may be connected to an external gas supply pipe.

The length of the recess is preferably so calculated and its position so chosen that the closing movement of the sliding plate uncovers the gas admission from the recess to the gas-permeable insert when the insert is in the working position in the metal discharge passage, and the opening movement of the sliding plate shuts off the gas supply when the gas-permeable insert withdraws from the discharge passage and the latter is opened for the discharge therethrough of molten metal.

The invention also extends to cases where the refractory component is in the form of a sleeve or nozzle brick for lining the well brick of a metallurgical vessel.

The gas-permeable insert may be itself sleeve-shaped and embedded in the middle of the sleeve. The gas-permeable insert is preferably inserted into a sleeve shaped sheet metal surround before being embedded, so that a clearance remains between the outside periphery of the insert and the inside surface of the metal surround, which clearance serves as a gas distributing chamber.

The invention also extends to a method of producing a nozzle brick in accordance with the invention in which the concrete pouring mould comprises an outer form and a central core for holding the gas-permeable insert in the desired position inside the mould. In a preferred form of the invention a jacket conforming with the shape of the form and consisting of a fire-resistant felt is introduced into the form before pouring begins, and is then firmly bonded to the refractory component.

The gas-permeable insert is preferably soaked with water before the concrete is poured.

As mentioned above the invention relates to sliding gate nozzles for vessels adapted to contain molten metal, particularly steel casting ladles and tundishes for the continuous casting of steel.

In such sliding gate nozzles thermal stresses (i.e. mechanical stresses due to differential thermal expansion) often arise for which it is very difficult to compensate. In addition, high thrusts are encountered. These may jointly give rise to bending and tensile stresses of a severity which the refractory material of the nozzle plates cannot withstand. The conditions are unlike those when refractory components and parts are purely statically loaded such as occur in furnace walls or roofs. There it is fairly easy to make allowance for any possible thermal stresses and strains. Tensile stresses can be largely avoided and dynamic thrusts do not arise.

In conventional sliding gate nozzles the above mentioned severe stresses are in practice absorbed by embedding the refractory material in the metal supporting structures of the gate in a densely compacted layer of mortar which makes all-over close surface contact with the refractory plate and the supporting structure. This generally accepted solution of the problem is technically satisfactory, provided it is properly applied. However, it requires skilled manual work and the functional reliability of the gate depends upon this work having been carried out with repeatedly uniform precision. The dependene of operating safety upon purely human factors is a major defect, bearing in mind the frequency with which the wearing material in sliding gates requires replacement and the danger of a serious steel leakage. An additional factor is that the service life of the refractory material located by embodiment in mortar is relatively short, particularly in the case of the orificed plates used for controlling such sliding gate nozzles as mentioned above.

It is an object of this aspect of the present invention to provide a sliding gate nozzle for vessels adapted to contain a metal melt, wherein the above described defects are at least reduced in severity.

This aspect of the invention relates to a sliding gate nozzle for vessels adapted to contain metal melts comprising at least one fixed and one movable plate, at least one of the plates being associated with a supporting frame and each plate having an orifice for the passage therethrough of the metal melt, characterised in that at least the movable sliding plate consists substantially of refractory concrete and on its side facing away from its sliding face is provided with a metal reinforcement embedded therein without the use of mortar, said reinforcement being thus anchored in the sliding plate so that tension, compression or shear forces cannot shift it, the sliding plate itself being located in the supporting frame without the use of mortar and the likewise movable supporting frame and the reinforcement preferably incorporating elements for transmitting the thrusts when the gate is operated.

The reinforcement preferably substantially comprises a metal sheet or a metal plate provided with elements firmly fitted thereto and projecting out of its principal plane, the said elements creating the non-shift anchorage of the reinforcement in the sliding plate against tensile and breaking forces or thrusts.

The elements projecting out of the principal plane of the reinforcement may be tabs integrally formed with the sheet metal or metal plate of the reinforcement and bent to embrace the sides and ends of the sliding plate. Alternatively the elements projecting from the principal plane of the reinforcement may be parts that have been bent out of the reinforcement plate itself.

In another alternative the elements projecting from the principal plane of the reinforcement may be indentations or corrugations formed in the sheet metal reinforcement or the reinforcement plate. In yet another alternative the elements projecting from the principal plane of the reinforcement may be projections such as pins welded to the sheet metal reinforcement or reinforcement plate. In a further alternative the sheet metal reinforcement or the reinforcement plate may be perforated.

The elements for transmitting the thrusts which arise when the gate is operated may comprise abutment or elevations on either side of the discharge passage of the molten metal through the supporting frame, said abutments cooperating with shoulders formed by the reinforcement.

The abutments on the supporting frame may extend across the direction of movement of the sliding plate and may consist of ribs extending a distance corresponding to the width of the sliding plate and each cooperating with a complementary shoulder formed by the reinforcement.

The elements on the supporting frame transmitting the thrusts which arise when the gate is operated may comprise a pin provided at least at one point spaced away from the discharge passage for the molten metal, said pin engaging a reinforcement socket in the sliding plate.

The reinforcement may rest on three and preferably six bearing abutments on the facing surface of the supporting frame.

Preferably at least three and preferably four of the bearing abutments are disposed symmetrically at a distance about the discharge passage for the molten metal, so that the sliding plate can freely bend slightly in the axial direction in the region surrounding the orifice.

The reinforcement contains an opening in the region of the discharge passage of the molten metal through the sliding plate, and this opening preferably has a diameter exceeding the diameter of the orifice, e.g. by an amount in the range of 120 to 300%.

Figure 2:
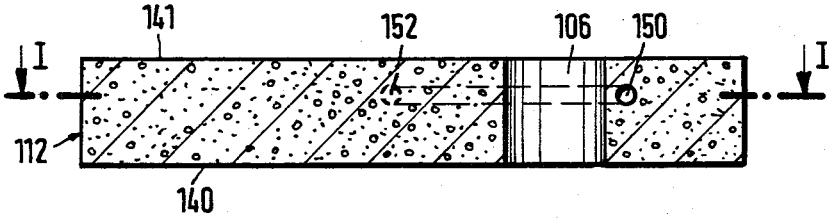
Figure 3:
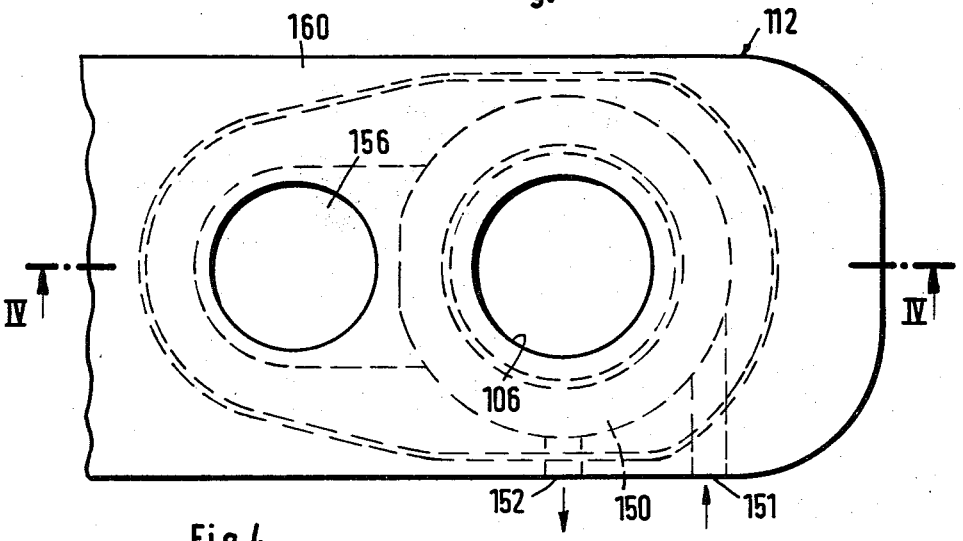
Figure 4:
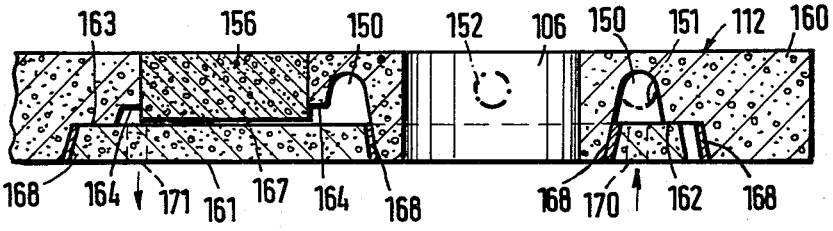
Figure 5:
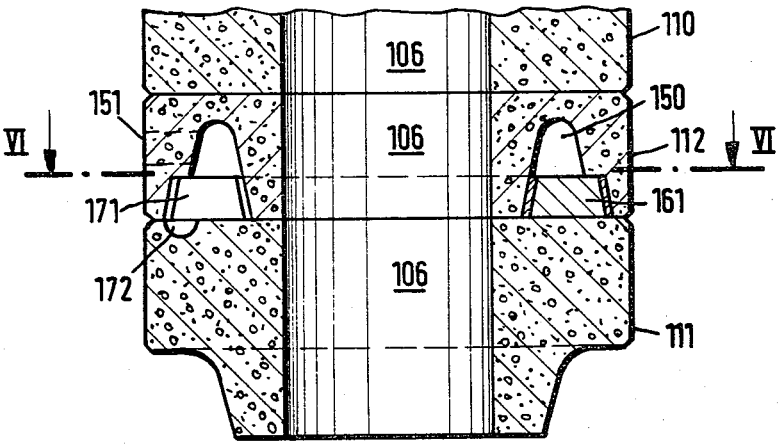
Figure 6:
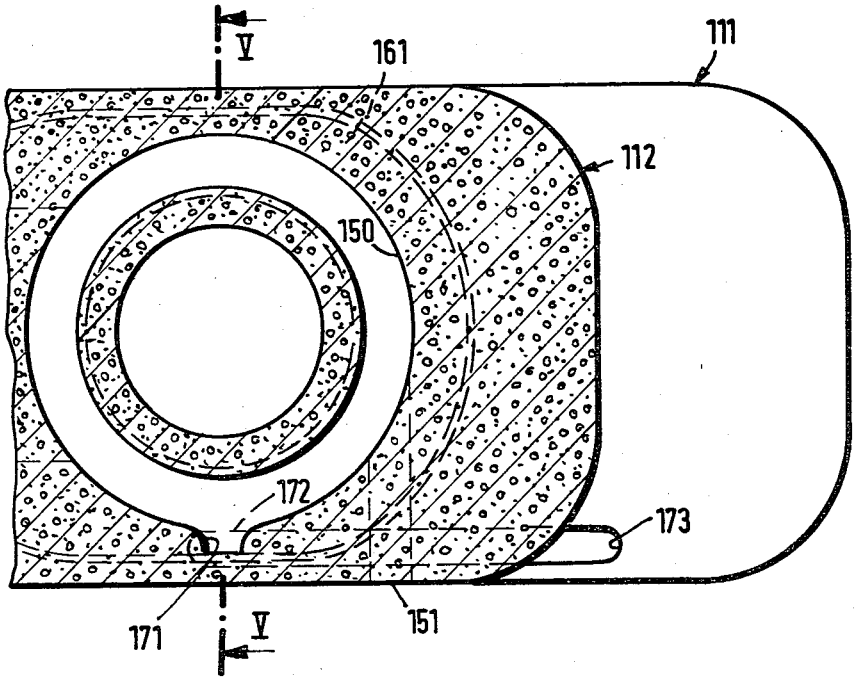
Figure 8:
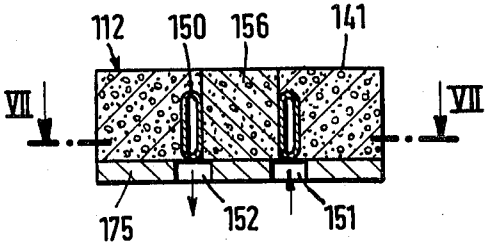
Figure 7:
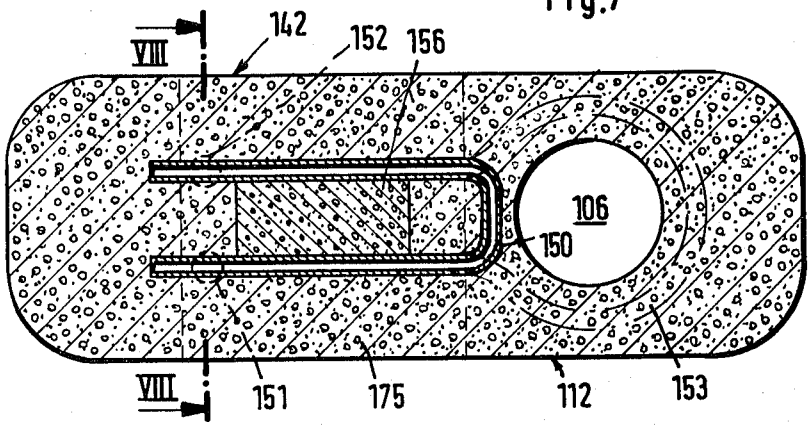
Figure 9:
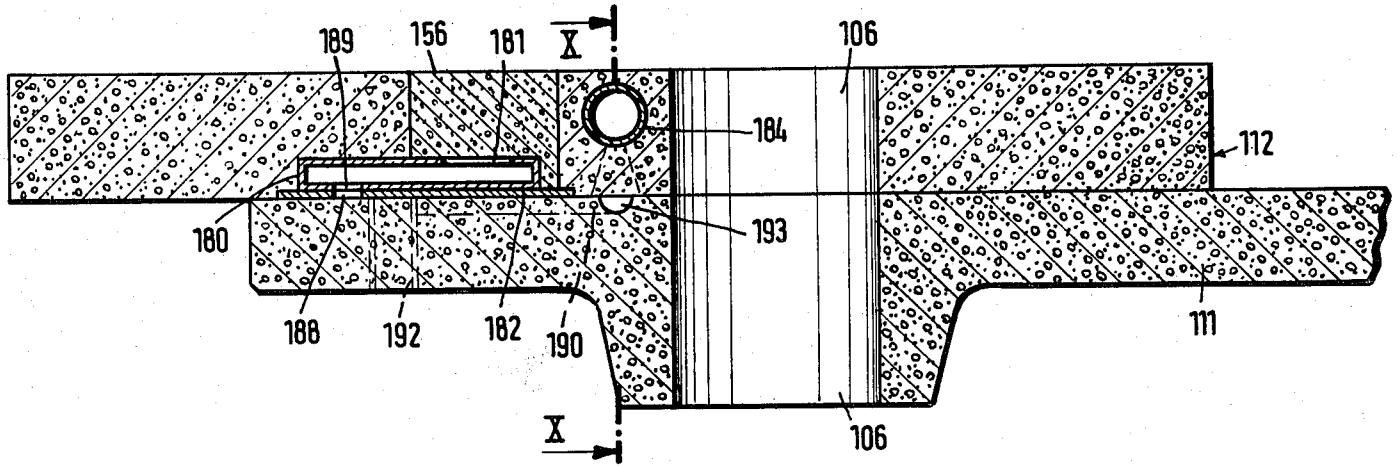
Figure 10:
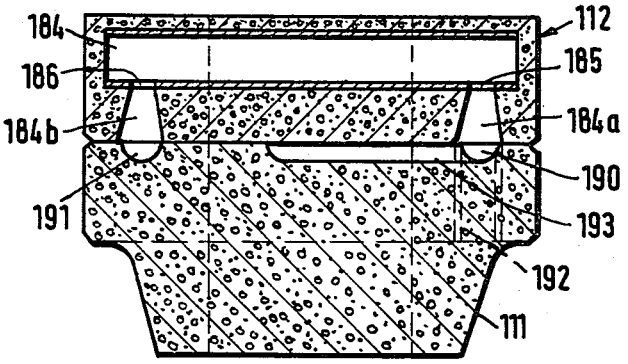
Figure 11:
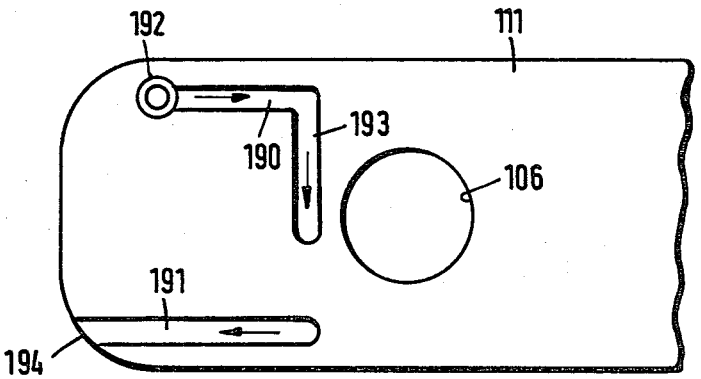
Figure 12:
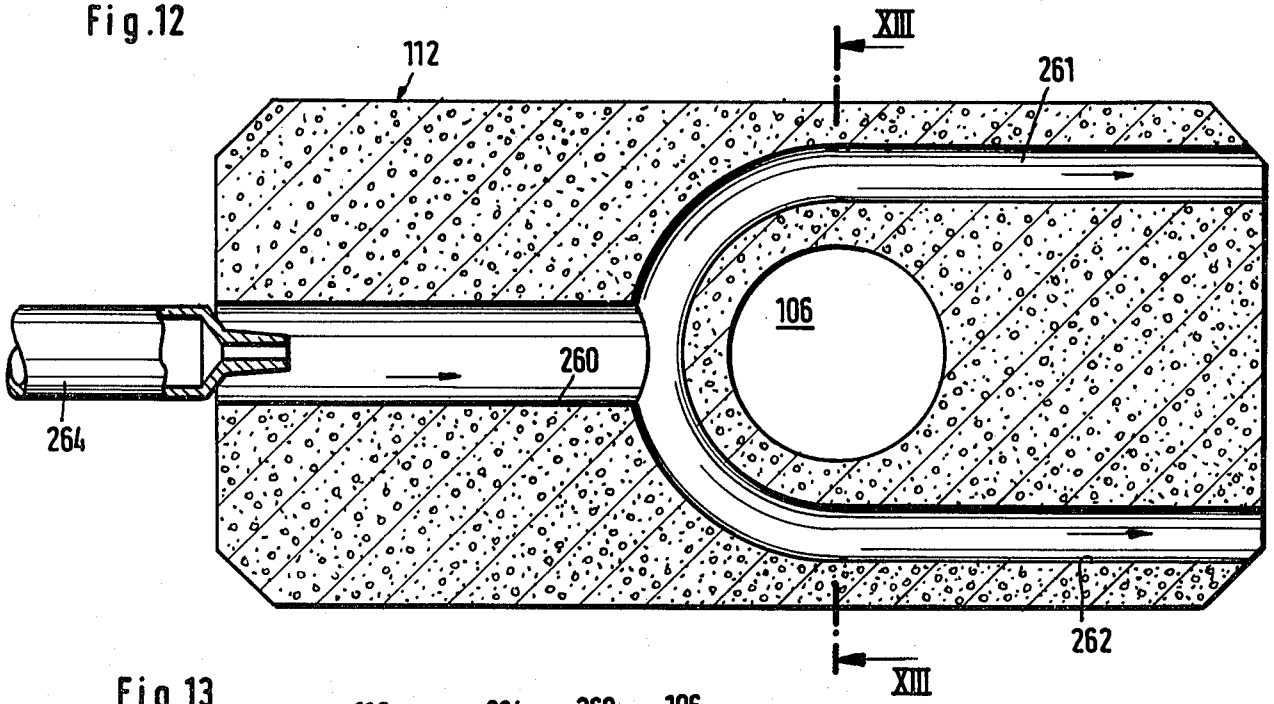
Figure 13:
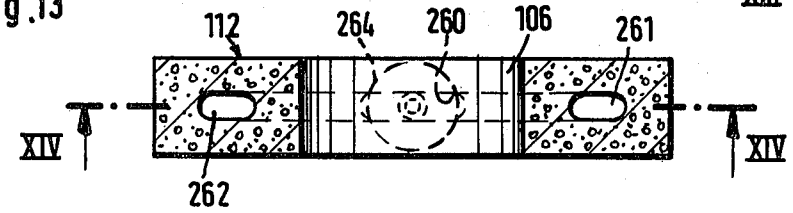
Figure 14:
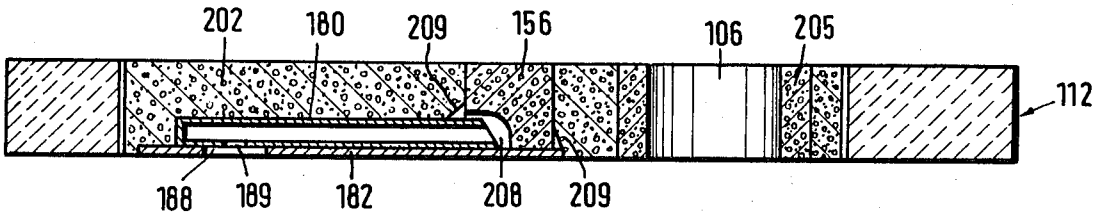
Figure 15:
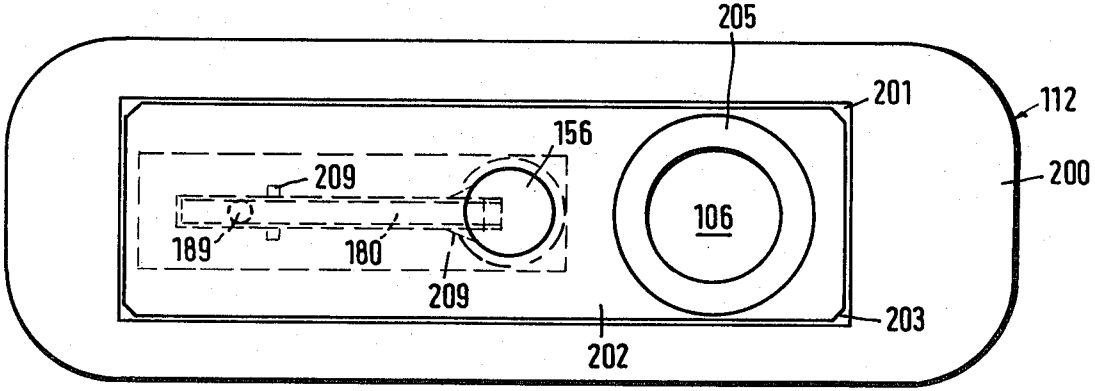
Figure 16:
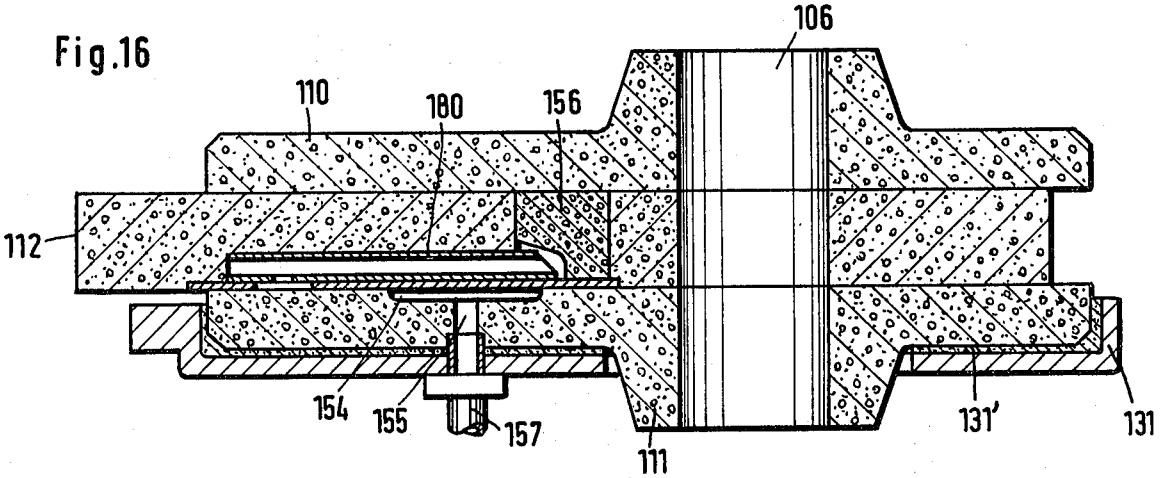
Figure 19:
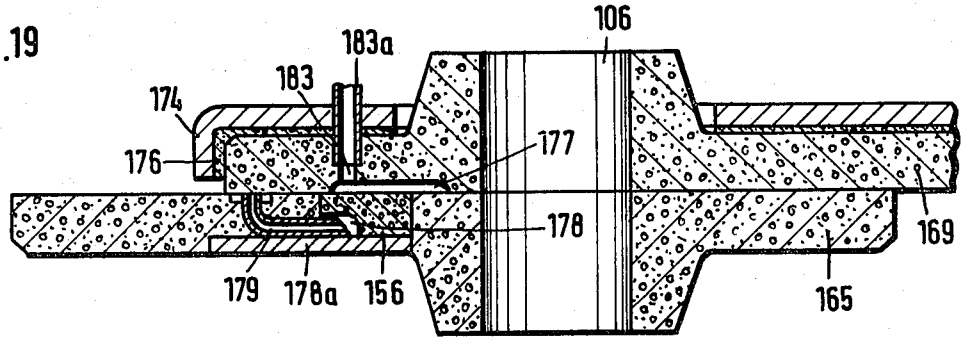
Figure 17:
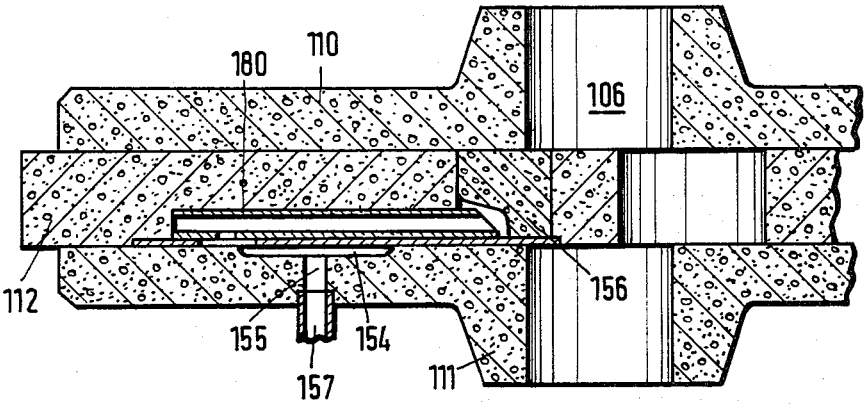
Figure 18:
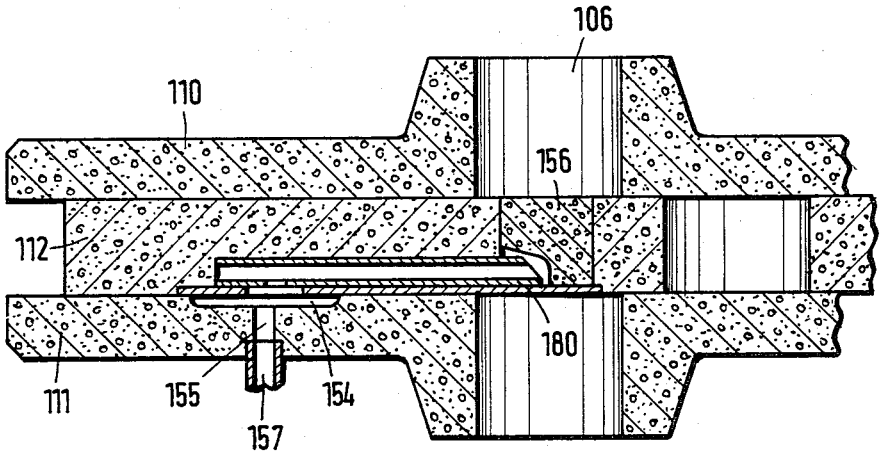
Figure 20:
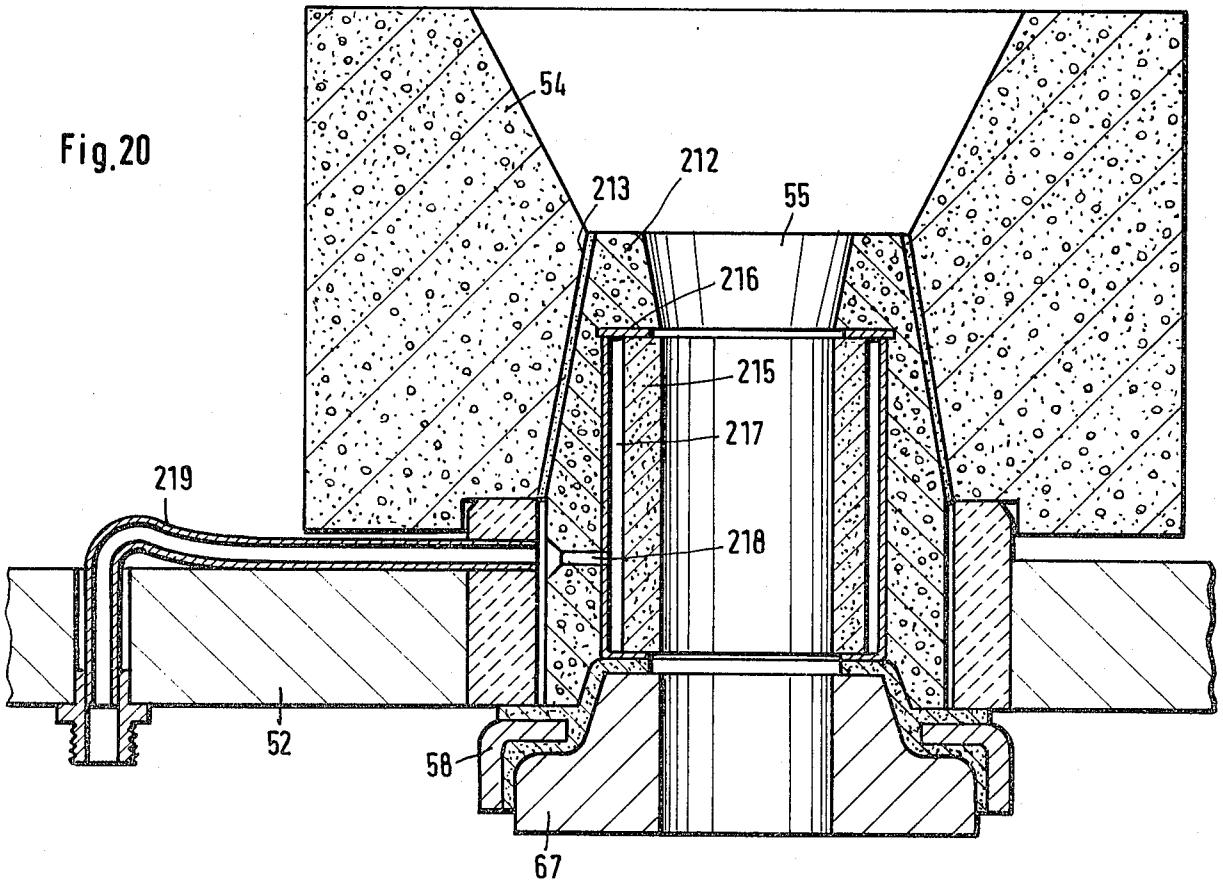
Figure 21:
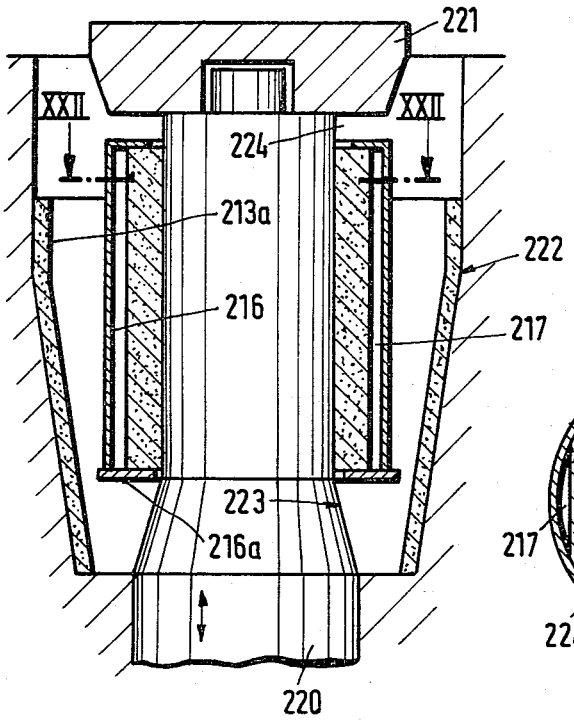
Figure 22:
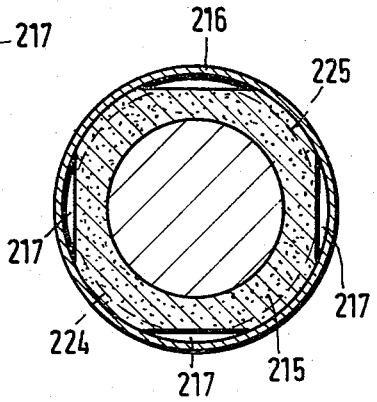
Figure 23:
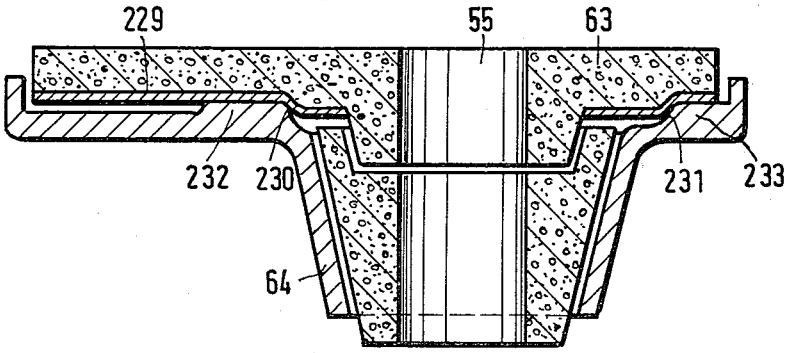
Figure 24:
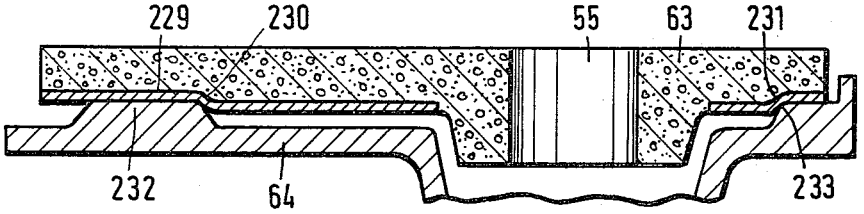
Figure 25:
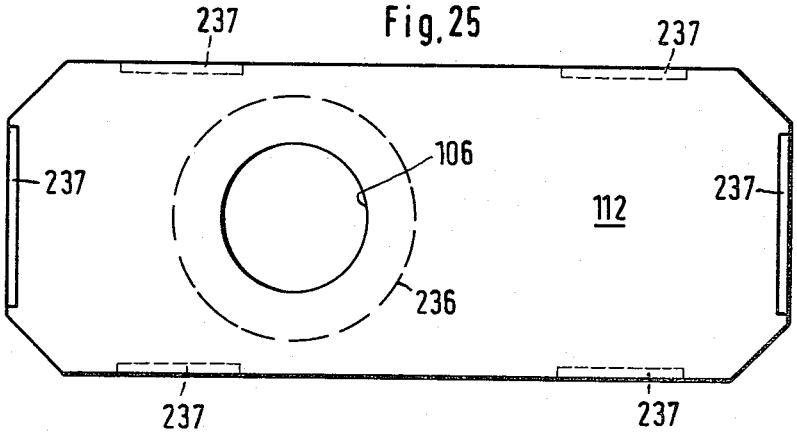
Figure 26:
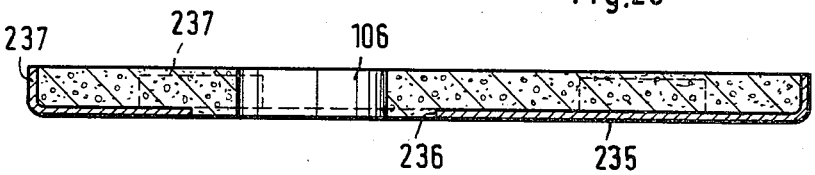
Figure 27:
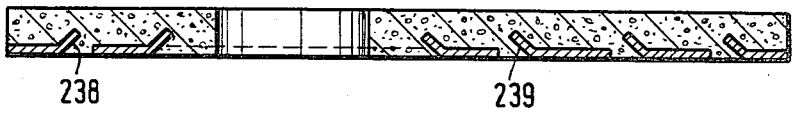
Figure 28:
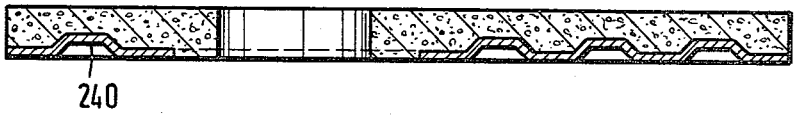
Figure 29:
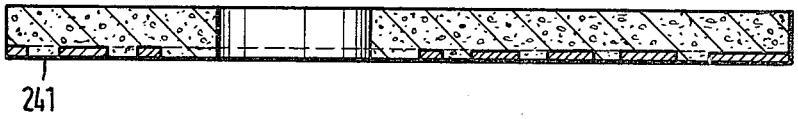
Figure 30:
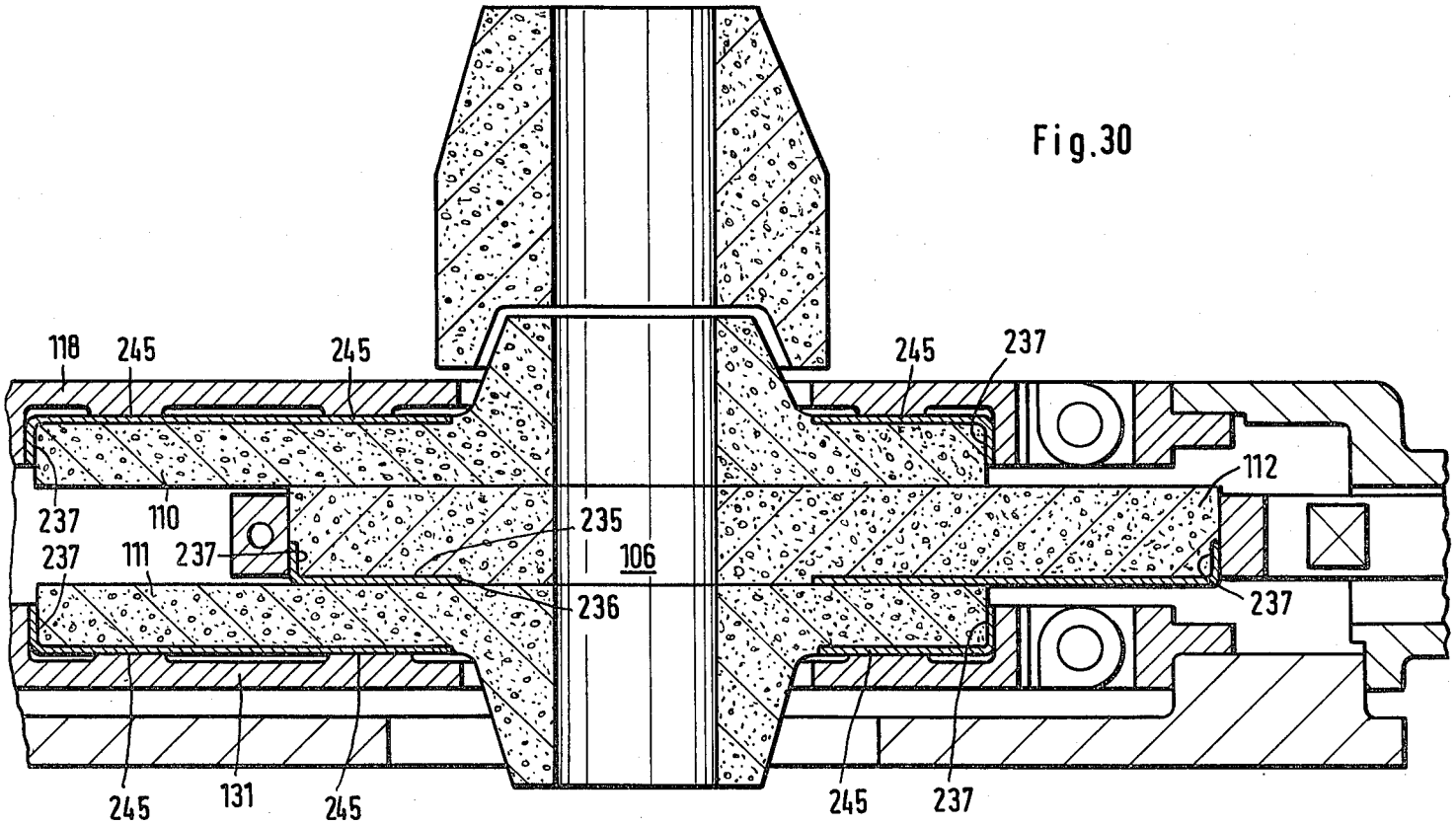
Figure 31:
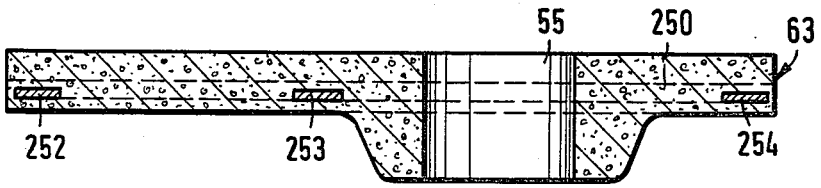
Figure 32:
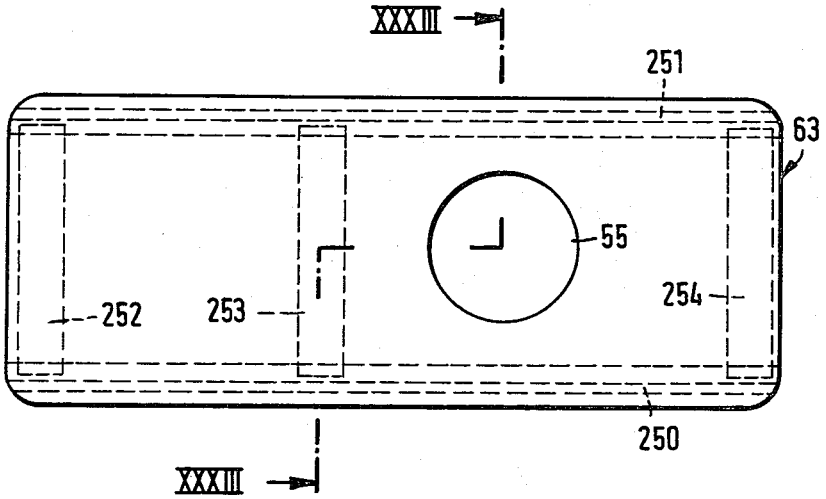
Figure 33:
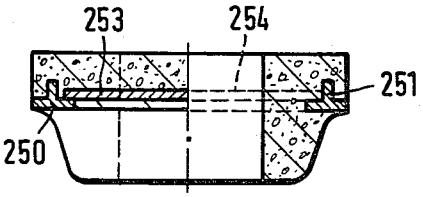
Figure 34:
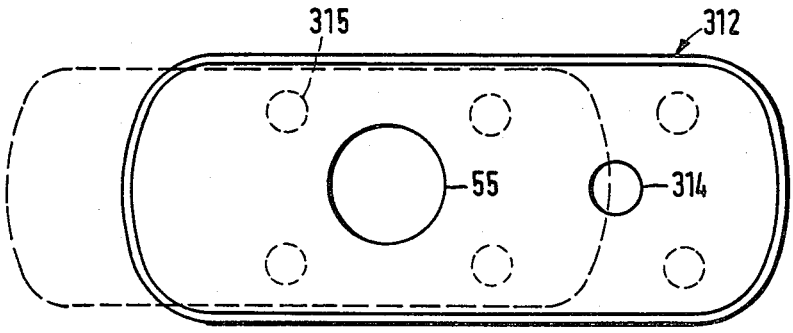
Figure 35:
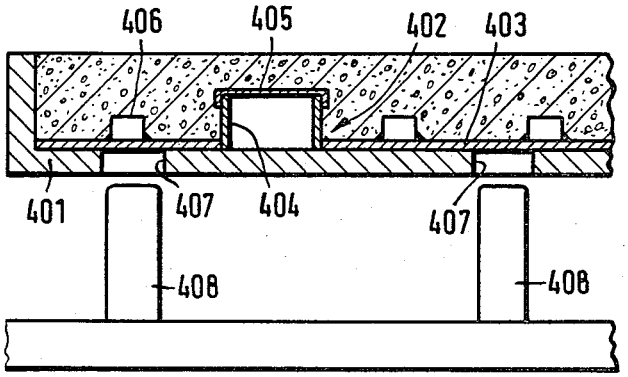
Figure 36:
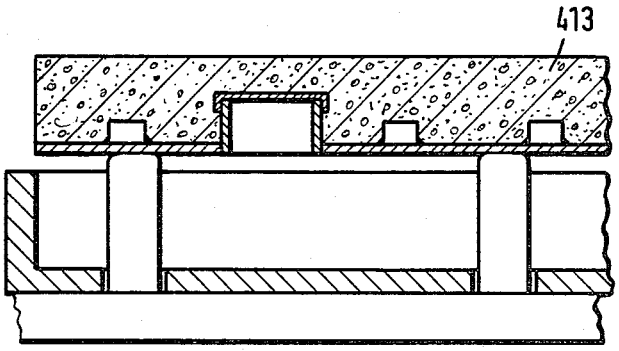
Figure 37:
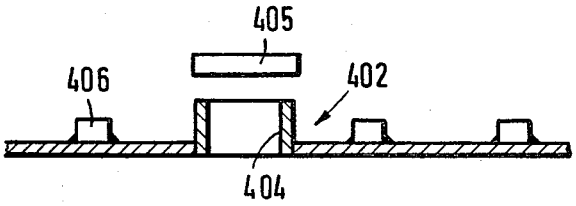
Figure 38:
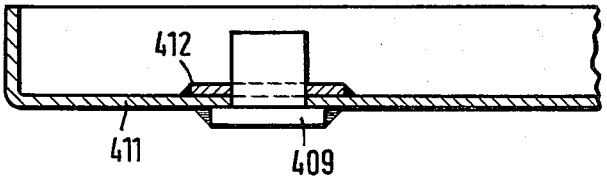
Figure 39:
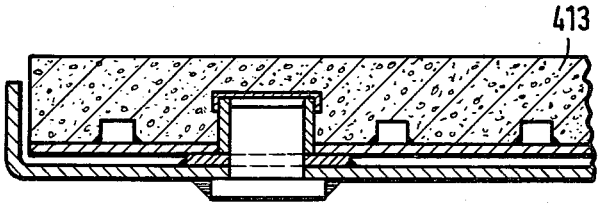

The invention may be put into practice in various ways and certain specific embodiments will be described by way of example to illustrate the invention with reference to the accompanying drawings, in which:

FIG. 1 is a diagrammatic cross sectional view taken on the line I—I of FIG. 2 of the middle plate of a three-plate sliding gate nozzle apparatus containing a duct formed therein in accordance with a first embodiment of the invention, FIG. 2 is a cross sectional view of the plate, taken on the line II—II of FIG. 1, FIG. 3 is a diagrammatic plan view of a second embodiment of a middle plate in accordance with the invention containing a duct formed therein and a porous insert, FIG. 4 is a cross sectional view of the plate in FIG. 3, taken on the line IV—IV of FIG. 3, FIG. 5 is a cross sectional view of a modification of the embodiment shown in FIGS. 3 and 4, taken on the line V—V of FIG. 6, FIG. 6 is a diagrammatic cross sectional view taken on the line VI—VI of FIG. 5 of the middle plate and of a partial plan view of the bottom plate of the embodiment shown in FIG. 5, FIG. 7 is a diagrammatic cross sectional view taken on line VII—VII of FIG. 8 of a third embodiment of a middle plate in accordance with the invention, FIG. 8 is a cross sectional view of the plate shown in FIG. 7, taken on the line VIII—VIII of FIG. 7, FIG. 9 is a diagrammatic cross sectional view taken on the longitudinal centre line, of a fourth embodiment of a middle plate and of part of the bottom stationary plate in accordance with the present invention, FIG. 10 is a cross sectional view of the embodiment shown in FIG. 9, taken on the line X—X of FIG. 9, FIG. 11 is a diagrammatic plan view of the upper surface of the bottom stationary plate of the embodiment shown in FIG. 9, FIG. 12 is a diagrammatic cross sectional view from above taken on the line XIV—XIV in FIG. 13 of a fifth embodiment of a middle plate in a three-plate sliding gate nozzle apparatus, provided with a duct that can be directly heated, FIG. 13 is a sectional view of the plate shown in FIG. 12 taken on the line XIII—XIII in FIG. 12, FIG. 14 is a diagrammatic cross sectional view of a sixth embodiment of a middle plate of a 3-plate sliding gate nozzle apparatus containing a gas-permeable insert embedded therein in accordance with the present invention, FIG. 15 is a plan view of the plate shown in FIG. 14, FIG. 16 is a cross sectional view of a 3-plate sliding gate nozzle apparatus for a vessel adapted to hold a metal melt showing a seventh embodiment of a middle plate in accordance with the invention which incorporates a gas-permeable insert embedded in the plate which is shown in the open position, FIG. 17 is a cross sectional view corresponding to FIG. 16 showing the middle or sliding plate in the partly closed position, FIG. 18 is a cross sectional view corresponding to FIG. 16 showing the middle sliding plate in the closed position, FIG. 19 is a cross sectional view of a 2-plate sliding gate nozzle apparatus incorporating an eighth embodiment of the invention namely a sliding plate having a gas-permeable insert embedded therein, FIG. 20 is a cross sectional view of a ninth embodiment of the invention, namely a nozzle containing a gas-permeable insert in the metal discharge passage of a vessel adapted to hold a metal melt;

FIG. 21 is a diagrammatic sectional view demonstrating the way in which the embodiment shown in FIG. 20 can be produced, FIG. 22 is a cross sectional view taken on the line XXII—XXII of FIG. 21 of the gas permeable insert shown in FIG. 21, FIG. 23 is a diagrammatic cross sectional view of a tenth embodiment of the invention exemplified by a sliding plate containing a metal reinforcement;

FIG. 24 is a view similar to FIG. 23 showing a modified form of construction, FIG. 25 is a plan view of an eleventh embodiment of the invention, FIG. 26 is a longitudinal sectional view of the embodiment shown in FIG. 25, FIG. 27 is a longitudinal sectional view of a twelth embodiment of the invention, FIG. 28 is a longitudinal sectional view of a thirteenth embodiment of the invention, FIG. 29 is a longitudinal sectional view of a fourteenth embodiment of the invention, FIG. 30 is a longitudinal sectional view of a fifteenth embodiment of the invention, FIG. 31 is a longitudinal sectional view of a sixteenth embodiment of the invention, FIG. 32 is a view of the embodiment shown in FIG. 31 seen from above, FIG. 33 is a cross sectional view on the line XXXIII—XXXIII of FIG. 32, FIG. 34 is a view of a seventeenth embodiment of the invention seen from above, FIGS. 35 and 36 illustrate one way of producing a sliding plate provided with a metal reinforcement, and FIGS. 37, 38 and 39 illustrate another way of producing a sliding plate provided with a metal reinforcement.

FIGS. 1 and 2 illustrate a middle plate 112 of a conventional three-plate sliding gate nozzle apparatus. Other parts of the apparatus are not shown since sliding gates as such are known.

A duct 150 for conducting a gas or a liquid extends from an inlet opening 151 roughly in the middle of one of the longer sides around a discharge passage 106 to an outlet opening 152 in the other longer side.

In an alternative arrangement (indicated by a dot-dash line 153) the duct 150 may extend further around the discharge passage 106.

In yet another alternative the duct openings 151 and 152 may be formed in one end of the plate 112, preferably at the end where the mechanism for actuating the plate is located.

The duct 150 is preferably formed in the upper half of the plate 112, i.e. in that half which faces the metal melt, for example at a height equal to 20 to 50% of the thickness of the plate measured from the upper surface 141 of the plate 112.

The plate 112 is made of refractory concrete suitable compositions for which are given in Examples 1, 2 and 3 below.

The duct 150 is formed for example by the provision of a steel tube in the mould and the refractory concrete is poured around the tube. The concrete is then allowed to set, for example for 12 hours, and the plate is then taken out of the mould and allowed fully to harden for another 48 hours at room temperature.

Instead of providing a steel tube a consumable material may be used to form the duct. Thus a tube made of cardboard or of a synthetic plastics material can be used which burns away when casting begins. Alternatively a core of low melting metal, such as CERROBEND, an alloy of tin, or Rose's metal can be used. This has the advantage that non-circular ducts of any desired cross section, such as rectangular or oval cross sections can be easily produced.

The CERROBEND material can be removed by the application of heat, for instance during the process of drying the plate. The alloy will then melt and run out, a process that can be accelerated by blowing low pressure steam through the duct.

The discharge passage 106 may be bored through the cured concrete either with a diamond tool or preferably this passage is moulded during the pouring of the concrete by providing a removable core, and if the passage is cylindrical the core may be of split construction to facilitate its extraction.

FIGS. 3 and 4 illustrate a modified form of construction of a middle plate 112 containing a cooling duct or heating duct 150 and a porous or gas-permeable insert 156.

The plate 112 is composed of two component parts, namely a body component 160 and a separate cover plate 161 for the duct. The body component 160 is first produced, as above described with reference to FIGS. 1 and 2, by pouring the concrete into a mould which forms the duct 150, in the present instance forming an open groove and rebated ledges 162 and 163 for the cover 161. The ledge 163 adjoins another recessed portion 164 which penetrates to a greater depth into the body component part 160 for the purpose of creating a gas distributing chamber surrounding a porous and gas-permeable insert 156. The height of the insert 156 is preferably slightly less than the depth of the ledge 163 so that a clearance 167 remains between the cover 161 and the inner face of the insert 156.

The cover 161 may be separately made of the same material as the body component 160 and it may be cemented into position with the same refractory concrete (as indicated at 168). The cover 161 may be reinforced by casting a metal plate into the same.

Alternatively, for some applications where differences in thermal expansion are not very serious, a steel cover, preferably of stainless steel, might also be used.

The discharge passage 106 and the inlet 151 and outlet 152 may be produced in the same way as described with reference to FIGS. 1 and 2. Alternatively they may be holes in the body component 160 drilled with a diamond drill.

External valve means are preferably provided for the purpose of allowing a gas e.g. air or nitrogen to enter through the inlet 151 and to leave through the outlet 152 when the sliding gate is open, escape through the insert 156 being prevented by the upper stationary plate (not shown), and in the closed position of the gate to enable the outlet 152 to be closed and to cause a gas preferably argon to be diverted to the insert 156 whence it escapes through the discharge passage in the upper stationary plate and enters the molten metal.

In an alternative embodiment the inlet and outlet openings, as indicated at 170 and 171, may be formed in the cover 161 and arranged to communicate with the gas supply and return through suitably located grooves in the bottom stationary plate (not shown). Such an arrangement will be described in greater detail with reference to FIGS. 9 to 11. A special form of this arrangement for an outlet is illustrated in FIGS. 5 and 6. In this instance the outlet 171 from the plate 112 is formed in the cover 161 and leads across the undersurface of the plate 112 to the outside. The outlet 171 communicates with a longitudinal groove 172 in the upper surface of the bottom stationary plate 111. When the middle plate 112 is in the casting position (open position) one end 173 of the groove 172 extends beyond the end of plate 112 thereby permitting the hot gas from the duct 150 to escape from the end 173 of the groove 172 in the bottom plate 111. At the same time the length of the groove 172 is so determined that when plate 112 is moved from its open into its closed position, the groove 172 will be completely covered by plate 112 and the gas in the duct 150 will be forced to pass through the porous or gas-permeable insert 156 into the melt in the metallurgical vessel. This form of construction clearly has the advantage of greater simplicity compared with the arrangement in FIGS. 3 and 4 and of providing automatic control of the gas.

FIGS. 7 and 8 illustrate a modified form of the construction of FIGS. 1 and 2, which includes a porous or gas-permeable insert 156. In this arrangement the middle plate 112 contains an insert 175 made of a normal ceramic material or of steel (ordinary or stainless steel) at the end 142 of the longer side of the plate. The facilitates the provision of the parts required for the gas supply connection and it also serves as a support for the porous insert 156 and the core for the duct 150 during production of the plate, both being secured, for example, with a mastic, to the plate 112 whilst the concrete is being poured into the mould. The duct 150 extends into the proximity of the discharge passage 106 or in another form of construction it embraces the same as indicated at 153.

The duct 150 is flattish and extends at a level which is between 20% and 80% of the thickness of the plate 112 away from its upper face 141. The porous insert 156 is rectangular and disposed between the arms of the duct 150.

In this form of construction the above-described CERROBEND material may be used. The insertion 175 is placed on the bottom of the mould, the CERROBEND core defining the shape of duct 150 is formed and the porous insert 156 so located between the arms of the duct that the CERROBEND material prevents the liquid refractory concrete from penetrating into the porous insert 156. The concrete mass is then poured into the mould. After the casting has set and has been removed and allowed to cure the CERROBEND material is removed by heating or by blowing it out with steam.

The discharge passage 106 is produced as has been described above and the upper and bottom surfaces of the plate are machined should this be necessary.

FIGS. 9 to 11 show another form of construction of the three-plate sliding gate in which the middle plate 112 as well as the bottom stationary plate 111 are of somewhat different construction.

A porous insert 156 is located in the longer part of the middle plate 112 and supplied with gas from a pipe 180 through an upwardly recessed opening 181 in the insert 156. The insert 156 and the pipe 180 are located on a metal plate 182 which has an opening 188 opposite to a corresponding opening 189 pointing downwards at the end of the pipe 180. A metal pipe 184 is provided inside the plate 112 transversely thereto between the insert 156 and the discharge passage 106 and this has an entry 185 and an outlet 186 both pointing downwards, 185 communicating with duct **184*a* and 186 with 184*b* which have openings in the undersurface of plate 112**.

As will be apparent from FIGS. 10 and 11 the bottom stationary plate 111 is provided with two parallel grooves 190 and 191 in its upper face which are covered by the lower face of the plate 112 and serve as gas ducts. The groove 190 extends from a metal or ceramic inserted component 192 serving as an inlet to the end of the plate 111 where it communicates with a cross groove 193 extending only across about half the width of the plate 111. The other groove 191 extends from a point facing groove 193 to an outlet 194. In the open position of the plates 111 and 112 the cold gas is flowing through the opening 192, the groove 190 and the opening **184*a* into the cooling tube 184 from whence it passes at the other end through the opening 184*b* and the groove 191 to the outlet 194**, through which the hot gas having cooled the plate can freely and safely blow off into the atmosphere.

The pipe 180 is so disposed that when the plates 111 and 112 are in the closed position (corresponding to a movement of the sliding plate 112 from left to right), the opening 188 communicates with groove 193 and gas will be conducted from the entry 192 through the insert 156. The pipe 184 in this position is closed.

In FIGS. 12 and 13 the middle plate 112 has a central flattened duct 260 which reaches from one end of the plate 112 into the proximity of the discharge passage 106 where it divides into two oval ducts 261 and 262 that embrace the discharge passage 106 and have outlets at the other end of the plate 112. A burner nozzle 264 (or an air lance) is inserted into the entry opening of the flattened duct 160, permitting the plate 112 to be heated by hot combustion gases. When an air lance is used the plate 112 can be cooled by compressed air being blown through the plate.

Although not shown in the drawings the entry openings into the duct or ducts in a preferred form of construction may tangentially communicate with the ducts to improve circulation of the heating or cooling fluid. This arrangement is particularly useful when the duct or ducts surround the discharge passage.

Examples of refractory concretes are hereunder given, such as may be used for the wearing parts that have been described above, and for making refractory parts provided with gas-permeable inserts, particularly for parts of sliding gate nozzles associated with vessels holding molten metal.

EXAMPLE 1

80% by weight of an aggregate containing 40% by weight of $Al_2O_3$ and having a particle size from 0 to 5 mm are mixed with 20% by weight of a fused alumina cement having a content of 40% by weight of $Al_2O_3$, 12 liters of water being added in respect of each 100 kg of the dry mix.

For the production of a wearing part this mix is poured into a mould and compacted by vibration should this be desirable. After having sufficiently set the concrete part is taken out of the mould, stored to cure and dried.

EXAMPLE 2

80% by weight of Guyana bauxite containing 88% by weight of $Al_2O_3$, particle size 0 to 5 mm was mixed with 20% by weight of alumina cement containing 70% by weight of $Al_2O_3$ and 10 liters of water per 100 kg of dry mix. This mix is further processed as described in Example 1.

However, if the plates are to be used for casting steels having melting points above 1500° C. which are cast at temperatures 50° C. to 60° C. above their melting points, the conditions which the plates have to withstand are very much more severe and in order to ensure a more reliable service special compositions must be used.

These conditions consist in a very severe mechanical erosive and chemical corrosive attack on the edges of the discharge passages of the plates combined with extreme thermal shock, the plates before the pour starts having a temperature of only 200° C. to 300° C.

For such very severe conditions it is preferred to use refractory concretes containing from 5 to 8% by weight of an alumina cement, 2.5 to 4% by weight of a pulverant refractory material (having a particle size of less than 50 microns and preferably less than 1 micron) such as a kaolin or bentonite, micronised silica, micronised alumina, micronised magnesia, micronised chromite or micronised fosterite, 0.01 to 0.30% by weight of an agent effective to increase the flowability of the composition comprising an alkali metal phosphate, alkali metal polyphosphate, alkali metal carbonate, alkali metal carboxylate or alkali metal humate and from 87.7 to 92% by weight of at least one refractory aggregate, desirably having a particle size not exceeding 30 mm, and desirably all of which pass a 10 mm mesh and about 25% of which pass an 0.5 mm mesh screen. The refractory aggregate may consist of calcined refractory clay, bauxite, cyanite, sillimanite, andalusite, corundum, tabular alumina, silicon carbide, magnesia, chromite or zircon or mixtures thereof.

An example of such a concrete is given below:

EXAMPLE 3

87.8 to 92% by weight of tabular alumina, particle size 0–6 mm are mixed with 5 to 8% by weight of alumina cement containing about 80% by weight of $Al_2O_3$, 2.5–4% by weight of micronised alumina and 0.01 to 0.3% by weight of alkali metal polyphosphate. 5 liters of water are added per 100 kg of dry mix. The mix is poured into the mould and can be compacted by vibration.

FIGS. 14 and 15 illustrate the sliding or middle plate 112 of refractory concrete of a 3-plate sliding gate nozzle apparatus in which a gas-permeable insert 156 is embedded. The insert 156 may be a porous body consisting of a coarse-grained mass of corundum or mullite sintered with a small quantity of a cementing agent and exhibiting a gas-permeability of at least 100 nanoperms.

The principal component of the sliding plate 112 is a pressed or cast body 200 containing a rectangular central window 201. In view of the relatively short duration of a pour (from the time of filling to the time of completely discharging the vessel) this body is heated to only a relatively low temperature, e.g. between 400° and 500° C. (when casting steel which heats up the walls of the discharge passage to more than 1500° C.). For this reason it is not absolutely necessary to make the body 200 of a refractory material. More important is the choice of a material that is dimensionally particularly stable and insensitive to temperature shock of the described kind, so that this body 200 can serve as a durable frame for the actual gating portion of the sliding plate 112.

The window 201 contains a member 202 which is of the same thickness as the body 200, but which has a slight clearance in the window 201 to facilitate replacement.

The member 202 has chamfered edges 203 and a cast-in cylindrical sleeve 205 which defines the discharge passage 106 for the metal through the sliding plate. This sleeve may be produced by pressing and firing or by casting a highly refractory mass. Without significantly increasing the cost of a sliding plate the sleeve may consist of a material of the highest quality, such as zircon, which can be standardised for size and shape and which will constitute only a small part of the entire volume of the plate.

The member 202 consists of refractory concrete of a quality that should be chosen to allow for the aggressiveness of the molten metal in question. In the majority of cases a concrete as specified above in Example 3 will satisfy the needs of the case. If the member 205, as is preferred, is used, then the member 202 may be made of a lower quality, such as that described in Examples 1 and 2 above.

The member 202 contains the gas-permeable insert 156 embedded therein supported by a metal plate 182 which has an opening 188 communicating with an opening 189 at one end of a metal tube 180 of which the other end opens into a distributing chamber 208 at the bottom of the gas-permeable insert 156.

The gas-permeable insert 156, the tube 180, and the metal plate 182 are assembled and cemented or otherwise joined together, as indicated at 209, before the refractory concrete is poured.

FIGS. 16, 17 and 18 illustrate a 3-plate sliding gate nozzle apparatus in which the sliding plate 112 corresponds to the sliding plate in FIGS. 14 and 15. The fixed plates are marked 110 and 111.

The lower fixed plate 111 is mounted in a supporting frame 131 in a prepared bed of mortar 131'. The metal discharge passage through the 3-plate sliding gate nozzle apparatus is generally identified by 106, but the sleeve for lining the discharge passage has been omitted.

In its upper surface the lower fixed plate 111 contains a recess 154 which communicates with a supply duct 155 and with a connecting gas pipe 157 for supplying the gas-permeable insert 156 with gas. When the gate is wide open, as in FIG. 16 no gas can enter.

However, when the gate is partly closed, as in FIG. 17, the gas entry opening is partly uncovered and some gas already passes into the discharge passage 106.

Finally, when the gate is fully closed as in FIG. 18, the gas supply is completely uncovered and the gas flows at maximum rate into the discharge channel 106.

The recess 154 is so located in the lower fixed plate 111 and it is of a length such that during the closing movement of the sliding plate 112 the supply of gas to the gas-permeable insert 156 through the gas pipe 157, the gas duct 155, the recess 154 and the tube 180 will begin when the gas-permeable insert 156 enters the discharge passage 106, and that a full rate gas supply to the gas-permeable insert 156 will be assured when the sliding plate 112 is in closing position.

FIG. 19 is an embodiment of a 2-plate sliding gate nozzle apparatus in which 165 indicates a sliding plate co-operating with a fixed plate 169 which in its underface contains a recess 177 supplied with gas through a duct 183 and a gas supply pipe **183*a***.

The 2-plate sliding gate defines a metal discharge passage 106. The sliding plate 165 contains a gas-permeable insert 156 which receives the gas through a duct 179 and a distributing chamber 178. The distributing chamber 178 is covered by a metal plate **178*a*. The gas is supplied in the same way as described in the case of the 3-plate sliding gate in FIGS. 16, 17 and 18**.

The fixed plate 169 is contained in a holder 174 and bedded in mortar 176.

FIGS. 20 to 22 illustrate the ninth embodiment of the invention in its application to a nozzle brick or sleeve.

FIG. 20 shows a nozzle brick 212 held in position in a mortar layer 213 in the bottom brick 54 of a vessel adapted to hold molten metal.

Alternatively, the mortar layer 213 could be replaced by a jacket of fire-resistant felt or ceramic fibre material. For the purposes of the invention it is of particular advantage to secure this jacket to the coned outer surface of the nozzle brick or sleeve 212 whilst the concrete is being poured. The advantage thus achieved is of a dual nature. Though providing a good seal the jacket will not adhere to the internal wall of the bottom brick 54. Hence the more rapidly wearing sleeve 212 can be easily removed without damage being done to the bottom brick 54, whereas on the other hand the preformed bond between the jacket and the sleeve ensures both correct positioning of the sleeve and an easy removal of the jacket when the sleeve 212 is removed.

It is of the essence that the sleeve 212 should consist of a refractory concrete because the operationally safe application of such a jacket which forms a layer of consistent thickness on the peripheral surface of the sleeve 212 demands the observance of close tolerances in overall dimensions and angles during the fabrication of the sleeve. This is assured when using a refractory concrete. In the case of a burnt material experience shows that such close tolerances cannot be assured without resorting to expensive subsequent machining.

The refractory ceramic fibre and felt material is preferably 3 to 4 mm thick, its bulk weight is 170 to 210 kg/cub.m, e.g. 192 kg/cub.m, and the fibre gauge is roughly 3 to 4 microns. The material is preferably compressible to half its thickness. If the sliding gate nozzle is to be used in the casting of a metal melt at temperature up to about 1260° C. a suitable felt would contain about 52% by weight of $SiO_2$ and 48% by weight of $Al_2O_3$. For higher temperatures up to about 1500° C. it is advisable to make use of a felt based on a chromium aluminium silicate having a content of for example 54.5% by weight of $SiO_2$, 42.3% by weight of $Al_2O_3$ and 3.2% by weight of $Cr_2O_3$ and a melting point above 1650° C.

The sleeve 212 contains a gas-permeable insert 215 preferably surrounded by a metal cylinder 216 which leaves a clearance creating a gas distributing chamber 217. The end of the cylinder 216 is sufficiently far away from the metal discharge passage 55 to be protected by the insulating effect of the refractory concrete. A gas duct 218 is provided and may be defined by a cast-in length of tube (not shown) or it may be bored into the brick. The gas may then be supplied to the porous insert through a tube 219 located between the ladle bottom and its brick lining and emerging through the bottom 52 on the outside of the frame 58 of the plate. If preferred the tube 219 might also be located between the bottom 52 and the frame 58 above the fixed plate 67.

The sleeve 212 in FIG. 21 may be produced in a mould 222 by pouring with the provision of cores 220 and 221. The core 220 is introduced through the bottom of the inverted mould form 222 and the metal sleeve 216 together with the insert 215 is placed on the metal disc **216*a*, which is held by the conical part 223 of the core. If a jacket of refractory felt is to be interposed between the sleeve 212 and the nozzle brick to form a seal, then a preformed coned felt jacket 213*a* is located inside the form. The core 221 is then positioned on the end of the core 220. The refractory concrete is poured into the form and the moulding taken out when set to be stored until fully hardened. Finally the duct 218 is produced by drilling (see FIG. 20**).

FIG. 22 relates to particulars of a preferred geometrical configuration of the gas-permeable insert 215. This has a generally square cross section and chamfered edges to enable it to fit into the cylindrical sleeve 216. The four cavities thus created represent a distributing chamber 217. Communication between the several cavities is provided by peripheral grooves 224 and 225.

EXAMPLE 4

Gas-permeable or porous inserts for sliding gate nozzle apparatus fitted to casting ladles can be produced as follows:

Raw material: High purity corundum of a particle size between 0.5 and 3 mm and between 1 and 3 mm.

Bonding agent:

(a) Clay containing not less than 43% $Al_2O_3$: up to 5 percent by weight (particle size 0 to 0.25 mm).

(b) Aluminium monophosphate: up to 1.5 percent by weight (50% aqueous solution).

Bricks are compacted from this mix under a pressure of 500 to 600 kp/sq.cm. and the compacted masses are then kilned for not less than four hours at 1600° C. The physical properties of the bricks are:

Permeability to gas: 500 to 700 nanoperm

Cold compressive strength: 250 to 350 kp/sq.cm.

A few general explanations will be of assistance: the proportion of open pores in volume percent is determined by the method of "Washburn". In this context it should be emphasised that the permeable pore volume may be only a proportion of total porosity.

The gas permeability (according to DIN 51 058) is measured in nanoperm. 1 nanoperm corresponds to $10^{-9}$ perms. A gas permeability of 1 perm is defined as the gas flow of 1 cc/sq.cm/sec. driven by a pressure differential of one dyne/sq.cm through a permeable body 1 cm thick, when the viscosity of the gas is 1 poise.

We refer now to FIG. 23. This shows a moveable sliding plate 63 of a two-plate sliding gate nozzle for a vessel adapted to contain a metal melt. Such sliding gates are known in the art and the fixed plate of the gate is not therefore shown.

The sliding plate 63 contains an orifice 55 for the passage therethrough of the metal melt. It is supported by a metal frame 64.

The side of the sliding plate 63 facing away from its sliding face is provided with a metal reinforcement 229 in the form of a flat metal sheet or a flat metal plate. The reinforcement 229 extends across the entire underface of the sliding plate 63 and it is connected to the plate so that neither tension, compression or shear forces can move it.

For transmitting the thrusts, which arise when the gate is operated, from the supporting frame 64 to the sliding plate 63, the supporting frame 64 is formed with elevations 232 and 233 which co-operate with correspondingly shaped shoulders 230 and 231 formed by the reinforcement 229. The elevations 232 and 233 on the supporting frame 64 may be ribs extending across the direction of movement of the sliding plate 63, the length of the ribs substantially equalling the width of the sliding plate 63.

It will be understood that the length and width of these ribs or elevations 232, 233 are arranged to comply with the demands that arise in any particular sliding gate nozzle. In FIG. 23 the elevations 232 and 233 on the supporting frame 64 are disposed a relatively short distance away from the orifice 55 for the passage of the metal, so that only comparatively slight flexing of the sliding plate 63 can occur in use.

If it is desired that the sliding plate 63 should be capable of more pronounced bending the elevations 232 and 233 on the supporting frame 64 and the cooperating shoulders 230 and 231 of the sliding plate 63 may be spaced further apart and more particularly the elevation 232 and the shoulder 230 may be located nearer the end of the sliding plate 63 as is illustrated in FIG. 24.

It will be understood that the elevations 232 and 233 on the supporting frame 64 and the shoulders 230 and 231 of the reinforcement 229 will be in direct engagement when the sliding gate is operated.

In the embodiment shown in FIGS. 25 and 26 the reinforcement again comprises a flat metal sheet or a flat metal plate 235. The reinforcement extends over the greater part of the underside of the sliding plate 112 and contains an opening 236 of a diameter exceeding the diameter of the orifice 106 for the molten metal. Preferably the diameter of the opening in the reinforcement 236 may exceed the diameter of the orifice 106 by an amount ranging between 120 and 300%, preferably from 140 to 200%. Consequently when the refractory concrete is being poured during the production of the sliding plate the gap between the orifice 106 and the opening 136 in the reinforcement will fill up with refractory concrete and the reinforcement 235 will thus be sufficiently insulated from the teeming metal whilst casting proceeds.

The reinforcement 235 is provided with six tabs 237 which are integrally formed on the edges of the reinforcement and bent upwards to embrace the sides and ends of the sliding plate from the outside.

FIGS. 27, 28 and 29 show three modified embodiments of this type of reinforcement which in each case contains an opening 236 having a diameter exceeding that of the orifice 106 as has above been described.

In the embodiment shown in FIG. 27 the reinforcement comprises parts 238 and 239 which have been bent out of the general plane defined by the reinforcement. In a manner similar to the tabs 237 in FIGS. 25 and 26 these bent parts create a firm anchorage for taking up tension, compression and shear stress that may arise between the reinforcement and the body of the sliding plate 112, the anchorage or mechanical interlocking being created when the plate is being produced from refractory concrete by casting.

In the embodiment shown in FIG. 28, the reinforcement contains indentations or depressions 240 which in a similar way also establish a secure anchorage between the reinforcement and the body of the sliding plate. In a modification of this embodiment the depression 240 are replaced by punched up perforated loops so that concrete can penetrate the loops and form a flush bottom face thereby increasing the interlocking between the refractory concrete and the metallic reinforcement.

In the embodiment shown in FIG. 29 the only difference is that the reinforcement is perforated at 241.

In all these examples the upper sliding face of the sliding plate is manufactured so that it is parallel to the underface of the reinforcement.

FIG. 30 shows a three-plate sliding gate nozzle in which the sliding plate 112 has the form shown in FIGS. 25 and 26. The fixed plates 110 and 111 of the sliding gate nozzle are provided with sheet metal reinforcement resembling the sheet metal reinforcement 235, the upper fixed plate 110 being provided with the reinforcement on its upper surface and the lower fixed plate 111 on its underface.

The sheet metal reinforcements are each formed with tabs 237, as in FIGS. 25 and 26, and these tabs 237 embrace the sides and ends of the sliding plates, 110, 111 and 112 from the outside whilst being embedded therein.

A supporting frame 118 is associated with the upper fixed plate 110 and a supporting frame 131 with the lower fixed plate 111. Both frames 118 and 131 are provided with a plurality of projections or bearing abutments 245 on their side facing the plate 110 or 111, and the sheet metal reinforcements 235 bear against these abutments. This ensures that the fixed plates 110 and 111 will be automatically fitted firmly and correctly without the need to use mortar.

Should it be desirable, sliding plates which are reinforced in accordance with the invention may be reduced in thickness to less than the thickness attainable by conventional pressed and fired sliding plates. For instance, the ratio of length to thickness may exceed 15:1, e.g. 20:1 to 25:1 or even more.

FIGS. 31 to 33 show a cast sliding plate 63 containing lengthwise and crosswide reinforcing elements formed on its underside by T-sections 250 and 251 extending along both sides of the plate and interconnected by three welded transverse plates 252, 253 and 254.

FIG. 34 shows in plan view a sliding plate 312 which contains a metal reinforcement like the above described sliding plates although this cannot be seen in the illustrated view from above. Only an opening 314 can be seen which is reinforced with sheet metal in a manner that will be later described with reference to FIGS. 35 to 39.

Bearing elements 315 indicated in discontinuous lines and conveniently formed by suitable elevations or abutments are provided on that side of the supporting frame (not here shown) which faces the sliding plate. The reinforcement of the sliding plate 312 rests on these bearing elements. Consequently the reinforced sliding plate 312 is freely suspended in the region of the thus capable of slight deformation when subjected to the effects of forces that arise in use.

The production of a sliding plate according to this aspect of the invention will now be more particularly described with reference to FIGS. 35 to 39.

FIG. 35 shows a mould 401 in which the prepared reinforcement 402 shown in FIG. 37 is first placed in position. In the illustrated case the reinforcement 402 consists of a metal sheet (or plate) 403 containing a tubular sheet metal insertion 404 covered by a cap 405. Projections, for instance in the form of metal pins or bosses, 406, are welded to the sheet metal reinforcement 403. These pins 406 serve to create a mechanical interlock and thus secure anchorage between the reinforcement 402 and the refractory concrete constituting the sliding plate. In a further preferred modification we provide the pins 406 with broadened heads or tangs or recesses so as to increase the interlocking of the metal reinforcement to the refractory concrete.

The bottom of the mould 401 contains holes 407 through which ejectors 408 can be introduced to eject the finished sliding plate from the mould 401. This action is illustrated diagrammatically in FIG. 36.

At the instant illustrated in FIG. 35 the mould 401 has been prepared for the production of the sliding plate by pouring refractory concrete and compacting the same, e.g. by vibration. The mould 401 is thus filled with refractory concrete, the surplus concrete being skimmed off over the edge which is machined parallel to the bottom of the mould 401.

It may be noted that the cap 405 may consist of any suitable material since its purpose is to prevent the refractory concrete from entering the tubular reinforcement insertion 404. However, if formed as a welded on steel cap, it could also increase the mechanical interlocking.

FIG. 36 as above mentioned, diagrammatically shows the plate being pushed out of the mould as soon as the concrete has initially set. The reinforcement sheet 402 serves as a support and prevents the sliding plate from warping in storage and during further treatment (curing, drying and so forth). At the same time the mould 401 is thus again quickly available for further use.

FIG. 38 diagrammatically shows a side elevation of part of a supporting frame 411 of conventional kind. According to the invention this supporting frame 411 is subsequently provided with a firmly fitted boss or stub 409 which is of a diameter so calculated that it will be a sliding fit in the tubular insertion 404, in the reinforcement 402. A flat disc 412 embraces the boss 409.

FIG. 39 shows the reinforced sliding plate 413 about to be assembled with the supporting frame 411. The reinforcing metal sheet 402 rests on the disc 412 which absorbs the vertical forces, transmitting the same through the supporting frame 411 to ways not shown in the drawing. The boss 409 inside the insertion 404 provides anchorage for the sliding plate against horizontal displacement in the supporting frame 411 without, however, preventing horizontal thermal expansion. The boss 409 also takes up the entire thrust when the sliding plate is operated. The transmission of this thrust by the boss 409 through the reinforcement 402 to the concrete component of the plate 413 is effected by elevations, projections or stubs 406 and the tube 404.

The disc-shaped bearing member 412 on the illustrated long side of the sliding plate corresponds to at least one corresponding abutment on the short side not shown in the drawing, resembling the abutments 245 in FIG. 30 and 315 in FIG. 34.

In the above-described embodiment the resultant bending stresses are taken up by the reinforcement. In the same way as in the embodiment according to FIG. 34 this affords the advantage that the sliding plate by bending will be relieved of undue compressive stress due to thermal expansion when locally heated in the neighbourhood of the discharge passage for the molten metal. Furthermore, the provision of these bearing abutments makes the reinforcement amenable to precise static calculation.

It must still be mentioned that the boss 409, if desired, may be provided with a central bore for the admission therethrough of a gas.

Examples of refractory concretes which can be used for the above sliding gate nozzles are described above in Examples 1, 2 and 3.

In a modification of the arrangements of FIGS. 35 to 39 a hole is drilled in the supporting frame 411 of a size to accommodate the tube 404 which is extended downwardly through the reinforcing element 402 so as to engage the hole in the frame 411. This tube can then be used as a working fluid inlet and within the plate can communicate with a duct for working fluid.

What is claimed as new and desired to be secured by Letters Patent of the United States is:

1. A refractory structure comprising a unitary body of refractory concrete material defining at least one discharge passage for molten metal passing through the body, at least one reinforcing element having at least one of its entire sides in intimate contact with said body and interlocked mechanically with the refractory concrete with which it is in intimate contact, the reinforcing element being separated by refractory concrete material from any surface of the refractory structure which contacts the molten metal in use, and means defining at least one duct for a working fluid in the body out of communication with said discharge passage when open.

2. A refractory structure as claimed in claim 1 wherein the duct for a working fluid comprises a tortuous duct located in the structure and extending from an inlet in a surface of the structure to an outlet in a surface of the structure.

3. The refractory structure as claimed in claim 2 in which the tortuous duct extends around at least 180° of the circumference of the discharge passage.

4. The refractory structure as claimed in claim 2 in which the means defining a duct for working fluid comprise gas permeable porous material opening out through a surface of the structure which will be in contact with molten metal during at least some of the time when the refractory structure is in use.

5. The refractory structure as claimed in claim 4 in which the gas permeable porous material is an insert directly embedded in the refractory concrete body and said duct includes ducting connecting the porous insert to an inlet to the ducting, spaced from the porous insert, and located in a side or a face of the structure.

6. The refractory structure as claimed in claim 5 in the form of a sliding plate for a sliding gate nozzle apparatus, the inlet to the ducting for the working fluid being located in a surface of the plate at a location which is remote from the part of the plate which will contact molten metal in use.

7. The refractory structure as claimed in claim 6 in which the inlet is located in one of the major faces of the plate and is so positioned as to communicate with the outlet to said ducting, adapted to supply working fluid, formed in a fixed plate with which the sliding plate cooperates when the sliding plate is in a position in which it is wished to introduce working fluid into the duct in the sliding plate.

8. The refractory structure as claimed in claim 4 in the form of a sliding plate for a sliding gate nozzle apparatus comprising a gas permeable insert, ducting and a metal plate, the gas permeable insert and ducting for the working fluid being located on said metal plate which is embedded in a face of the plate at a position remote from the part of the plate which will contact molten metal in use.

9. The refractory structure as claimed in claim 8 including a fixed plate, wherein in the sliding plate the ducting for the working fluid passes round at least 180° of the circumference of the discharge passing before reaching the porous insert and the ducting has an additional outlet located in one of the principal faces of the plate at a position, remote from the part of the plate which will contact molten metal in use, and such that the said outlet is adapted to cooperate with a duct or recess formed in the fixed plate with which the sliding plate is adapted to cooperate in use, the duct in the fixed plate having an outlet in the face which contacts the sliding plate, the positioning of the inlets and outlets of the duct in the fixed plate and the additional outlet in the sliding plate being such that gas cannot pass therethrough when the sliding plate is in the closed position.

10. The refractory structure as claimed in claim 1 in the form of a nozzle brick for the outlet opening of a metallurgical vessel.

11. A refractory structure comprising a unitary body of refractory concrete material defining at least one discharge passage for molten metal passing through the body, at least one reinforcing element having at least one of its entire sides in intimate contact with said body and interlocked mechanically with the refractory concrete with which it is in intimate contact, and said discharge passage being defined by an insert material embedded in the refractory concrete having better wear resistance than the refractory concrete, the reinforcing element being separated by refractory concrete material from any surface of the refractory structure which contacts the molten metal in use.

12. The refractory structure as claimed in claim 10 having a refractory felt partially embedded in its outer surface.

13. A nozzle brick comprising a body of refractory concrete material defining a discharge passage for molten metal passing through the body, at least one reinforcing element having at least one of its entire sides in intimate contact with said body and interlocked mechanically with the refractory concrete with which it is in intimate contact, the reinforcing element being separated by refractory concrete material from any surface of the nozzle which contacts the molten metal in use and at least one duct for a working fluid in the body, the duct comprising a gas permeable porous sleeve forming at least part of the wall of the discharge passage and an inlet in a face of the nozzle brick at a location remote from the part of the nozzle brick which will contact molten metal in use.

14. The refractory structure as claimed in claim 13 in which the duct for the working fluid communicates with at least substantially the whole of the face of the porous insert remote from the face which will contact the molten metal in use.

15. A refractory structure comprising a unitary body of refractory concrete material defining at least one discharge passage for molten metal passing through the body and at least one reinforcing element having at least one of its entire sides in intimate contact with said body and interlocked mechanically with the refractory concrete with which it is in intimate contact, the reinforcing element being separated by refractory concrete material from any surface of the refractory structure which contacts the molten metal in use and including keying members which key the reinforcing element to the refractory structure.

16. The refractory structure as claimed in claim 15 in which the reinforcing element is located at a face which, when the structure is in use, will be away from the face of the structure which will contact molten metal by at least 20% of the thickness of the structure.

17. The refractory structure as claimed in claim 15 in which the keying members comprise tabs extending into the refractory concrete.

18. A refractory structure comprising a unitary body of refractory concrete material defining at least one discharge passage for molten metal passing through the body, at least one reinforcing element having at least one of its entire sides in intimate contact with said body and interlocked mechanically with the refractory concrete with which it is in intimate contact, the reinforcing element being separated by refractory concrete material from any surface of the refractory structure which contacts the molten metal in use and means defining at least one duct for a working fluid, the structure comprising at least two separate parts secured to each other at least in use, the duct being defined between the said parts.

19. A sliding gate nozzle apparatus adapted for use with metallurgical vessels comprising at least one fixed and one movable plate, a supporting frame associated with at least one of the plates, and each plate having a discharge passage for the passage therethrough of molten metal, at least one of said plates comprising a refractory structure, at least one reinforcing element at least partially embedded within the refractory structure and interlocked mechanically with the refractory concrete with which it is in intimate contact over the whole of any surface of the reinforcing element which is juxtaposed to the refractory concrete, the reinforcing element being separated by refractory concrete material from any surface of the refractory structure which contacts the molten metal in use, the reinforcing element being provided on a side of the refractory structure facing away from a sliding face, at least one of said plates being located in the supporting frame with which it is associated free of mortar, the supporting frame and the reinforcing element including cooperating elements for transmitting thrust therebetween when the gate is operated, and said structure including means defining at least one duct for a working fluid in the structure, said duct for working fluid comprising a tortuous duct located in the structure and extending from an inlet in a surface of the structure to an outlet in a surface of the structure, said means comprising gas permeable porous material opening out through a surface of the structure which will be in contact with molten metal during at least some of the time when the refractory structure is in use, said gas permeable porous material being an insert directly embedded in the refractory concrete structure and said duct including ducting connecting the porous insert to an inlet to the ducting, spaced from the porous insert, and located in a face of the structure.

20. The sliding gate nozzle apparatus as claimed in claim 19 in which the elements for transmitting the thrusts which arise when the gate is operated comprise abutments on either side of the discharge passage in the supporting frame, said abutments cooperating with shoulders on the plate formed by the reinforcing element.

21. The sliding gate nozzle apparatus as claimed in claim 20 in which the abutments on the supporting frame extend across the direction of movement of the sliding plate and consist of ribs extending a distance corresponding to the width of the plate, each cooperating with a complementary shoulder formed by the reinforcing element.

22. The sliding gate nozzle apparatus as claimed in claim 19 in which the elements on the supporting frame which are adapted to transmit the thrusts which arise when the gate is operated comprise a pin provided at least at one point spaced away from the discharge passage, the said pin engaging a reinforcement socket in the plate.

23. The sliding gate nozzle apparatus as claimed in claim 19 in which the reinforcing element rests on at least three bearing abutments on the inside surface of the supporting frame.

24. The sliding gate nozzle apparatus as claimed in claim 23 in which at least three of the bearing abutments are disposed symmetrically at a distance about the discharge passage so that the sliding plate can freely bend slightly in the axial direction in the region surrounding the discharge passage.

25. A method of conditioning a sliding plate of a sliding gate nozzle of a metallurgical vessel, said sliding plate having a discharge passage through which molten metal flows and a duct for working fluid which comprises passing heating fluid through the duct out of communication with said discharge passage prior to moving the sliding plate from the closed position to the open position at least for the first pour.

26. A method of conditioning a sliding plate of a sliding gate nozzle of a metallurgical vessel, said sliding plate having a discharge passage through which molten metal flows and having a duct for working fluid which comprises passing cooling fluid through the duct out of communication with said discharge passage at least part of the time that molten metal is passing through a discharge passage in the plate.

27. The method as claimed in claim 26 in which the working fluid is compressed air so that the plate is cooled at least in the vicinity of the discharge passage.

28. A method of conditioning a sliding plate of a sliding gate nozzle for use with molten metal having a discharge passage through which molten metal flows and a duct for working fluid which comprises passing working fluid through the said duct out of communication with said discharge passage through which molten metal flows, said working fluid being a hot gas produced by combustion of a fuel so that the plate is heated at least in the vicinity of the discharge passage.

* * * * *